US005931749A

United States Patent [19]

Hagey

[11] Patent Number: 5,931,749

[45] Date of Patent: Aug. 3, 1999

[54] CONTOURED GRIP FOR A RACQUET

[76] Inventor: Edward H. Hagey, 3653 Jennifer St., San Diego, Calif. 92117

[21] Appl. No.: 08/963,549

[22] Filed: Nov. 3, 1997

Related U.S. Application Data

[63] Continuation-in-part of application No. 08/793,351, Feb. 24, 1997, and application No. 08/812,906, Mar. 10, 1997, which is a continuation of application No. 08/459,302, Jun. 2, 1995, Pat. No. 5,671,926, which is a continuation-in-part of application No. 08/363,606, Dec. 23, 1994, Pat. No. 5,492, 324.

[51] Int. Cl.[6] ..... A63B 49/08

[52] U.S. Cl. ..... 473/551; 473/549

[58] Field of Search ..... 473/549, 551, 473/298, 300, 568; 81/489, 22, 177.1; 16/110 R

[56] References Cited

U.S. PATENT DOCUMENTS

| | | | |
|---|---|---|---|
| 412,479 | 10/1889 | Davis . | |
| 2,031,161 | 2/1936 | Hamel . | |
| 2,302,191 | 11/1942 | Covington . | |
| 4,065,127 | 12/1977 | Fagan . | |
| 4,067,573 | 1/1978 | Key . | |
| 4,213,609 | 7/1980 | Swanson . | |
| 4,355,803 | 10/1982 | Rama . | |
| 4,438,925 | 3/1984 | Lindstrom . | |
| 4,545,584 | 10/1985 | Adam . | |
| 4,641,838 | 2/1987 | Gabrielidis . | |
| 4,664,381 | 5/1987 | Aaron | 473/551 |
| 4,736,950 | 4/1988 | Doyle . | |
| 4,828,261 | 5/1989 | Kleylein . | |
| 4,836,544 | 6/1989 | Lai | 473/551 |
| 4,848,746 | 7/1989 | Klink . | |
| 4,968,032 | 11/1990 | Redekop . | |
| 5,018,734 | 5/1991 | Allsop . | |
| 5,042,804 | 8/1991 | Uke . | |
| 5,269,516 | 12/1993 | Janes . | |
| 5,295,684 | 3/1994 | Bracho . | |
| 5,316,316 | 5/1994 | Lai . | |
| 5,322,278 | 6/1994 | Jeanrot . | |
| 5,398,930 | 3/1995 | Gibson . | |
| 5,460,372 | 10/1995 | Cook . | |
| 5,492,324 | 2/1996 | Hagey . | |
| 5,671,926 | 9/1997 | Hagey | 473/549 |

FOREIGN PATENT DOCUMENTS

| | | |
|---|---|---|
| 519312A1 | 12/1992 | European Pat. Off. . |
| 020488 | 2/1975 | France . |
| 3628618 | 11/1987 | Germany . |
| 3726753 | 2/1989 | Germany . |
| 3733425 | 2/1989 | Germany . |
| 3842126 | 2/1990 | Germany . |
| 4019039 | 12/1991 | Germany . |
| 157421 | 5/1991 | Taiwan . |
| 210025 | 7/1993 | Taiwan . |
| 2201699 | 2/1994 | Taiwan . |
| 230376 | 9/1994 | Taiwan . |
| 662110 | 5/1979 | U.S.S.R. . |
| 20882 | of 1909 | United Kingdom . |
| 2133294 | 7/1984 | United Kingdom . |
| WO8902297 | 3/1989 | WIPO . |
| WO 96/20029 | 7/1996 | WIPO . |

*Primary Examiner*—Raleigh W. Chiu
*Attorney, Agent, or Firm*—Walter W. Duft

[57] ABSTRACT

A racquet handle having a contoured topography providing unique configurations that increase the player's racquet head awareness and which may be manufactured as an assembly adjustable along the length of the handle which will aid in positioning a player's hand in advantageous positions for stroke improvement.

15 Claims, 14 Drawing Sheets

FIG. 15
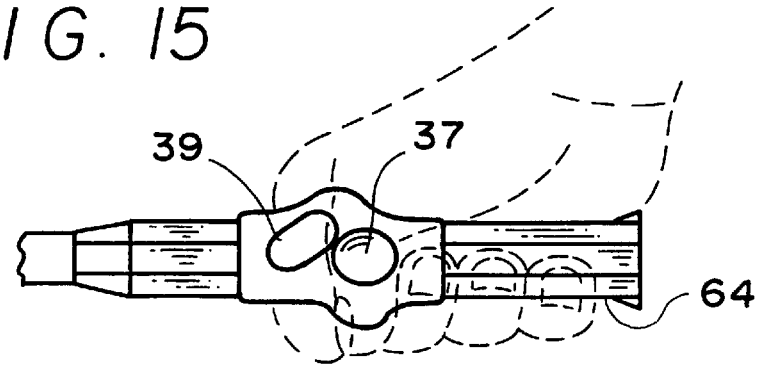
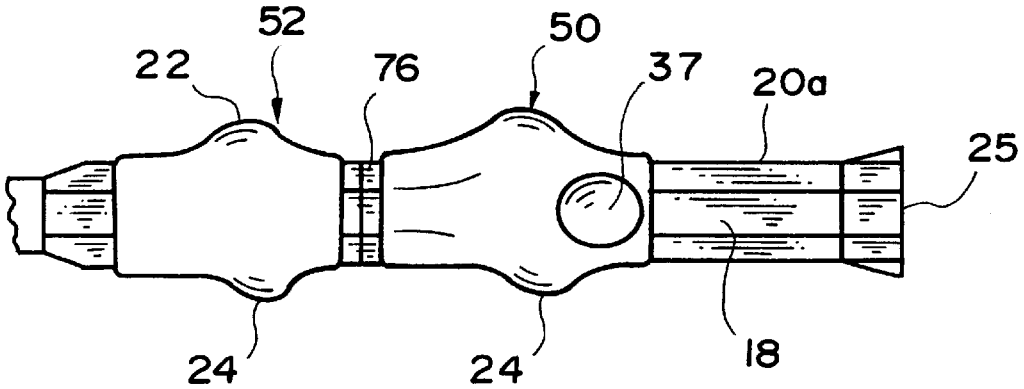
FIG. 16
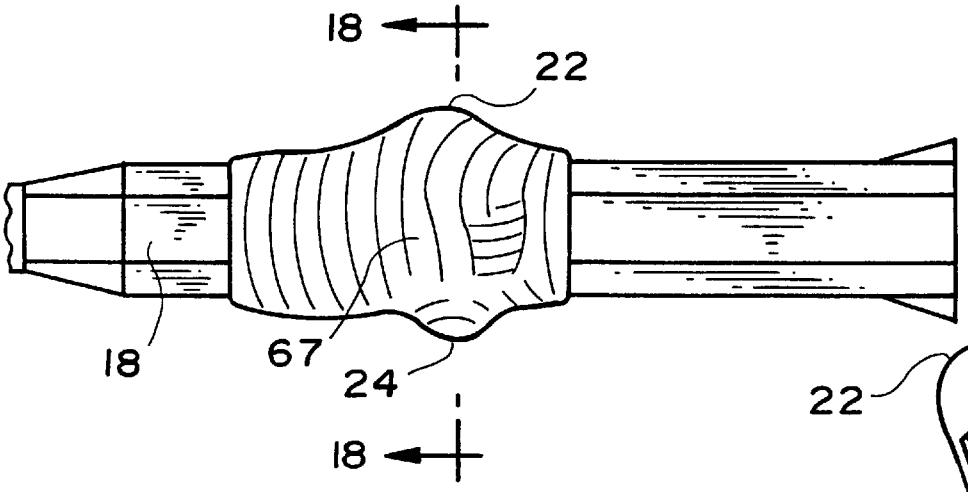
FIG. 17
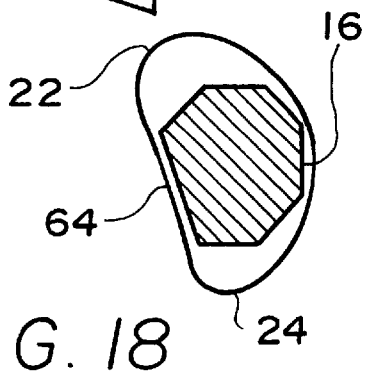
FIG. 18

CONTOURED GRIP FOR A RACQUET

This is a continuation-in-part of co-pending U.S. patent application Ser. No. 08/812,906 filed Mar. 10, 1997, which is itself a continuation of U.S. patent application Ser. No. 08/459,302 filed Jun. 2, 1995, now U.S. Pat. No. 5,671,926, and which is itself a continuation-in-part of U. S. patent application Ser. No. 08/363,606 filed Dec. 23, 1994, now U.S. Pat. No. 5,492,324. This is also a continuation-in-part of copending U.S. patent application Ser. No. 08/793,351 filed Feb. 24, 1997.

BACKGROUND OF THE INVENTION

The present invention is directed to further improvements in racquets for use in several sports, but is particularly directed toward an improved gripping area for a tennis racquet handle.

Of all the racquet sports, tennis is unique in its ball speed (pace) and the great deal of court coverage required by the players. Players must hit many balls on the run or after traveling great distances. For expert play, it is essential that during these maneuvers the player have a superb sense or awareness of the location and attitude (angular disposition) of the racquet head with respect to the player's hand. Sometimes the ball must be struck when it has little or no speed. At other times, the racquet will encounter high impact forces because of the pace with which the opponent has struck the ball. Additionally, the player must return tennis balls with various spins. The player is oftentimes required to change grips while on the run. Racquet preparation and proper grip are essential to expert play. Players must change their grips while running and under other difficult circumstances.

There have been many improvements in tennis racquets in the past several decades. Prior to 1970, almost all racquets were made of laminated wood. This limited the size of racquet heads and, consequently, almost all racquet heads had the same dimensions. For many years, manufacturers have made handles of different peripheral sizes, almost all of which were octagonal. With the advent of steel, aluminum, fiberglass, and graphite racquets, size limitations have been substantially eliminated and racquet heads have become larger.

With larger racquet heads, off-center contact with the ball creates greater torque. When a fast-moving tennis ball is struck any place but in the so-called "sweet spot," a great deal of torque is imparted to the racquet which must be resisted by the hand of the racquet user. This makes racquet head awareness of even greater importance. Racquet head awareness is that sense of knowing the angular relationship and distance of the stringed head to the hand. Topographical features on the handle which are felt and recognized by the player's hand enhance awareness. Although conventional octagonal handles impart some awareness, the instant invention described herein increases awareness dramatically.

For almost a century, tennis racquet handles have been octagonal in cross section. After about 1930, it became common to wrap the octagonal handle with a leather strip for comfort and friction. This racquet handle design is almost universally used in tennis racquets at the present time. Before leather wrappings became popular, many handles had grooves and ridges to increase friction. A collar or retention ridge was often secured to the base end of the handle to prevent slippage.

In order to appreciate the full measure of this invention, it should be understood that the vast majority of players use two different grips when stroking the ball. One grip is used for the forehand and the other grip is used for the backhand. Players typically use the backhand grip, or a grip between the forehand and backhand grip, for the serve. Grips vary from player-to-player and the teachings herein disclose handles which will accommodate the requirements of many players.

The most common forehand grip (known as the Eastern forehand), and that preferred by many tennis instructors, places the first knuckle of the index finger squarely behind one of the planar surfaces of the octagonal handle, the palm is in engagement with that planar surface parallel to the plane of the racquet head, and the butt of the hand against a retention ridge. The fingers are angularly disposed with respect to the handle axis.

In the grip known as the Eastern backhand, the hand is rotated until the finger segments between the first and second knuckles of the third, fourth, and fifth fingers are in a plane parallel to the racquet head. The thumb is typically placed diagonally across the opposite planar surface. This specification will use this grip terminology for purposes of explanation.

Some players do not like the "feel" of these commonly-used grips and will rotate the hand to one side or the other. This can reduce power and, in many instances, reduce racquet head awareness. In the embodiments described herein, contours are disclosed which will accommodate a variety of grips without the loss of power or racquet head awareness. In some instances, an improper grip is assumed because of a lack of skill or because of the difficult circumstances encountered during a grip change. The configuration and contours of the handle herein described will permit a considerable array of grips and at the same time aid the user in reaching a desired grip.

As taught in my co-pending applications, there is a bowl or protrusion to receive the area between the thumb and forefinger and a trigger to receive the index finger. The protrusion and the trigger increase the player's awareness of his or her hand along the length of the handle and increase racquet control. In one embodiment of the instant invention, a second protrusion is provided adjacent the trigger so that the player will have additional racquet handle awareness and control during certain strokes. In another embodiment of the instant invention, the first protrusion is located on one side of the handle axis and defines a surface extending at a skewed angle to the axis to engage the base of a player's index finger. If desired, the first protrusion can be extended beyond the side of the handle. In addition, a thumb depression can be provided below the first protrusion and an extended thumb support lip can be provided below the thumb depression. In another embodiment of the instant invention, an angled surface is provided on one side of the handle to support the first knuckle of a user's forefinger in a Western forehand grip. In yet another embodiment of the instant invention, a concavity is provided in the handle to receive a player's third, fourth, and fifth fingers, which helps facilitate a backhand grip. In a further embodiment of the instant invention, a thumb groove can be provided approximately transverse of the axis of the racquet so that a Western backhand is facilitated. In still another embodiment of the instant invention, a pair of thumb depressions are provided. In a still further embodiment of the instant invention, a pair of handle contour areas are provided for two-handed backhand play. One contour area is for the right hand and one is for the left hand. In a still further embodiment, an angled surface is provided for a user's thumb to facilitate top spin backhand strokes. In a still further embodiment, a thumb depression is formed in combination with either a bowl or protrusion to receive the area between the thumb and forefinger, or a trigger to receive the index finger. Alternatively, either a bowl or protrusion, or a trigger, could be provided by itself without a thumb depression. In a still further embodiment for two-handed backhand use, a single contour area is provided that includes a protrusion to receive the area between the thumb and forefinger of the principal playing hand, a trigger to receive the index finger of the principal playing hand, and an angled depression formed in the racket head side of the protrusion to receive the padded area at the base of the thumb of the secondary playing hand. The side of the handle can also be angled to receive the first knuckle of the index finger of the secondary playing hand. In yet another embodiment, a concavity in the upper side of the handle receives the butt of the principal playing hand to bring the grasping fingers closer together and provide a better grip. The trigger can also be positioned toward the base of the handle relative to the protrusion so that the thumb of the principal playing hand can engage the trigger during backhand strokes. In a still further embodiment, one or more indentations are formed in a side portion of the handle to receive the first knuckle of the index finger of the principal playing hand for positioning during service and forehand strokes.

In addition to the foregoing embodiments, novel constructions in accordance with the invention allow contoured areas formed in accordance with the invention to be adjustably mounted on a conventional handle as an alternative to molding a contour on a handle during racquet manufacture. In addition, molded constructions are disclosed that allow the weight of the racket handle to be reduced. A racquet for a right-handed player is described herein, but it should be understood that left-handed racquets are just the reverse.

SUMMARY OF THE INVENTION

With the above in mind, this invention has a principal objective to provide a new handle configuration for a tennis racquet which combines the geometry of the player's hand with preferred racquet movement so that maximum power and control is obtained by the user.

A further objective of this invention is to provide a handle configuration which makes the player fully aware of the location of his hand along the length of the handle.

Another objective of the invention is to provide a bowl or protrusion to receive the area of a user's hand between the thumb and forefinger, and a trigger to receive the index finger. The protrusion and the trigger increase the player's awareness of his or her hand along the length of the handle and increase racquet control.

Still another objective of the invention is to provide a second protrusion adjacent the trigger so that the player will have additional racquet handle awareness and control during certain strokes.

Still another objective of the invention is to locate the first protrusion on one side of the handle axis and define a surface extending at a skewed angle to the axis to engage the base of a player's index finger. If desired, the first protrusion can be extended beyond the side of the handle. In addition, a thumb depression can be provided below the first protrusion and an extended thumb support lip can be provided below the thumb depression.

Still another objective of the invention is to provide an angled surface on one side of the handle to support the first knuckle of a user's forefinger in a Western forehand grip.

Still another objective of the invention is to provide a concavity in the handle to receive a player's third, fourth, and fifth fingers, which helps facilitate a backhand grip.

Still another objective of the invention is to provide a thumb groove approximately transverse of the axis of the racquet so that a western backhand grip is facilitated.

Still another objective of the invention is to provide a pair of thumb depressions.

Still another objective of the invention is to provide a pair of handle contour areas for two-handed backhand play. One contour area is for the right hand and one is for the left hand.

Still another objective of the invention is to provide an angled surface for a user's thumb to facilitate top spin backhand strokes.

Still another objective of the invention is provide a thumb depression in combination with either a bowl or protrusion to receive the area between the thumb and forefinger, or a trigger to receive the index finger. Alternatively, either a bowl or protrusion, or a trigger, could be provided by itself without a thumb depression.

Still another objective of the invention is to provide, for two-handed backhand use, a single contour area that includes a protrusion to receive the area between the thumb and forefinger of the principal playing hand, a trigger to receive the index finger of the principal playing hand, and an angled depression formed in the racket head side of the protrusion to receive the padded area at the base of the thumb of the secondary playing hand. A related objective is to angle the side of the handle to receive the first knuckle of the index finger of the secondary playing hand.

Still another objective is to provide a concavity in the upper side of the handle to receive the butt of the principal playing hand to bring the grasping fingers closer together and provide a better grasp. In accordance with this objective, the trigger can also be positioned toward the base of the handle relative to the protrusion so that the thumb of the principal playing hand can engage the trigger during backhand strokes.

Still another objective is to form one or more indentations in a side portion of the handle to receive the first knuckle of the index finger of the principal playing hand for positioning during service and forehand strokes.

In the handle configurations described herein and those described by my co-pending applications, it may be desirable to be able to cast these configurations and secure them at selective locations along the length of the handle to improve a player's performance. In one system, the handle is formed with a grooved section along a portion of its length in which rail portions of the grip are received. The grip molds are moved along the length of the racquet handle to a desired location and secured thereto by screws or the like. Then, the racquet handle is wrapped with leather strips as is conventional. In another system, a contour section is added to a handle using multiple pieces secured to the handle by adhesive. In yet another system, a contour area is molded or otherwise attached on a racket using light weight material to reduce handle weight.

BRIEF DESCRIPTION OF THE DRAWINGS

FIG. 15 is a side elevational view showing a configuration having two thumb depressions and a reduced base periphery according to another embodiment of the invention;

FIG. 16 is a side view disclosing two contoured areas on the handle shaft according to another embodiment of the invention for those using a two-handed grip;

FIG. 17 is a side view according to another embodiment of the invention showing a contoured surface that eliminates one of the ridges of the handle;

FIG. 18 is a cross-sectional view of the racquet handle of FIG. 17 taken along line 18-18 therein;

DESCRIPTION OF THE PREFERRED EMBODIMENTS

Figure 1:
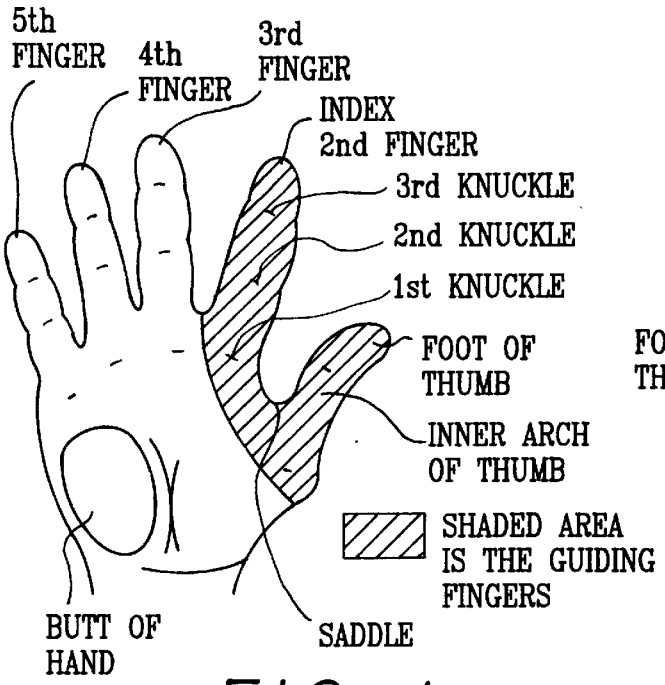
FIGS. 1–3 are views of the hand presented for purposes of nomenclature.
Figure 2:
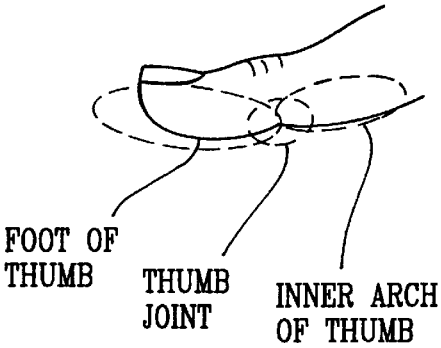
Figure 3:
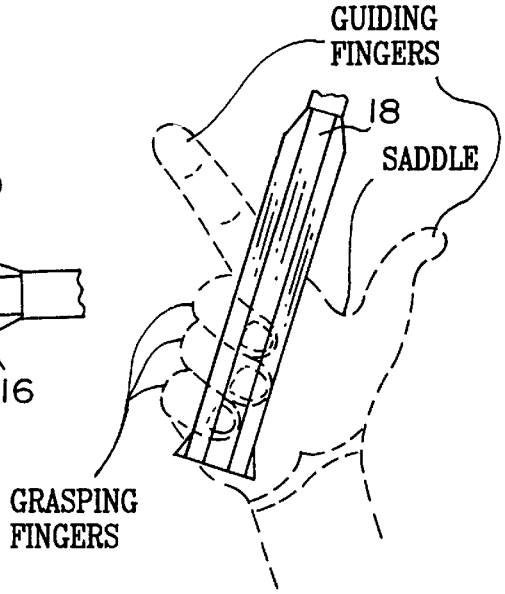

For nomenclature purposes, please refer to FIGS. 1, 2, and 3 showing the hand of a tennis player. Note that the index finger, thumb, and the saddle area have been shaded. These portions of the hand contribute guidance and control to the player. The third, fourth, and fifth fingers provide much of the grasping power. FIG. 3 illustrates this concept.

Figure 4:
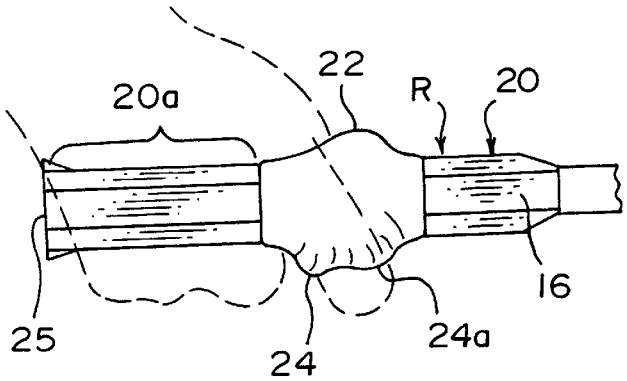
FIG. 4 is a diagrammatic side view showing a player's hand disposed over a tennis racquet handle constructed according to one embodiment of this invention.

Referring now to the other drawings wherein like numerals indicate like parts, and FIG. 4 in particular, the numeral 20 indicates a tennis racquet handle of the racquet R. The numeral 20*a* indicates a lower portion of the handle 20 adjacent a base 25. The tennis racquet handle 20, including the lower portion 20*a,* includes side surfaces 16 and 18 as shown in FIGS. 3 and 4. The top surface of the octagonal portion of the handle is indicated by the numeral 19 and the bottom surface by the numeral 19'. In the parent applications a protrusion 22 and a trigger 24 have been disclosed. The protrusion 22 provides a surface against which the saddle formed by the index finger and the thumb can be placed. This engagement locates the hand and/or acts as a pivotal point when changing from forehand to backhand grips and vice versa. The trigger 24 supports the player's index finger for added control and for increasing the player's awareness of his or her hand along the length of the handle.

Figure 5:
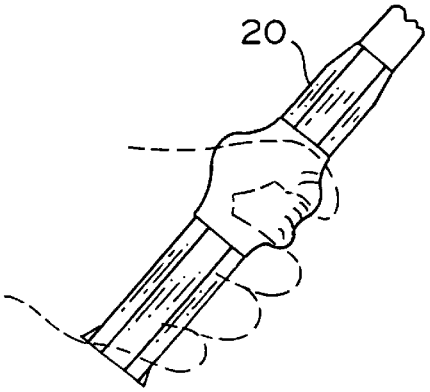
FIGS. 5 and 6 are diagrammatic side elevational views to illustrate operation.
Figure 6:
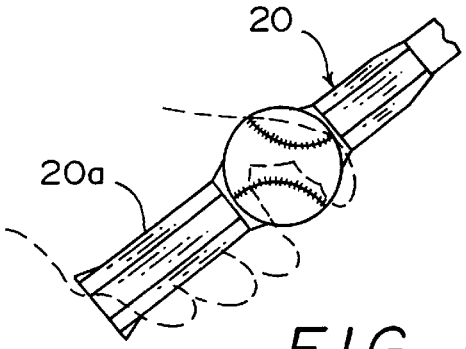

As seen in a new embodiment shown in FIG. 4, another bulge 24*a* can be added adjacent the trigger 24. The rounded surface of bulge 24*a* causes the hand to lengthen or stretch itself along the racquet and locates a portion of the index finger radially outwardly from the axis of the handle for better control and racquet head awareness for some players. The player will engage this surface 24*a,* especially in the serve and overhead, to give an extra downward force on the racquet head as the plane of the head is moving forward. This provides an extra snap action to the racquet head, much in the same way a baseball pitcher obtains spin on his curve. FIGS. 5 and 6 are diagrammatic representations of this phenomenon.

Figure 7:
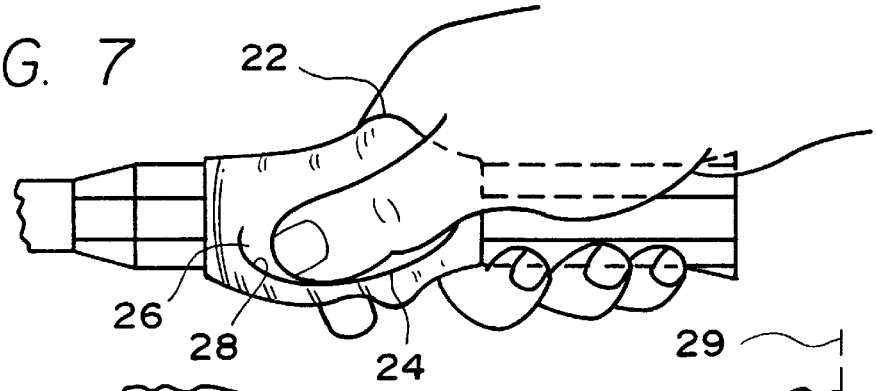
FIG. 7 is a left side elevation showing a backhand grip of another embodiment of the present invention.
Figure 8:
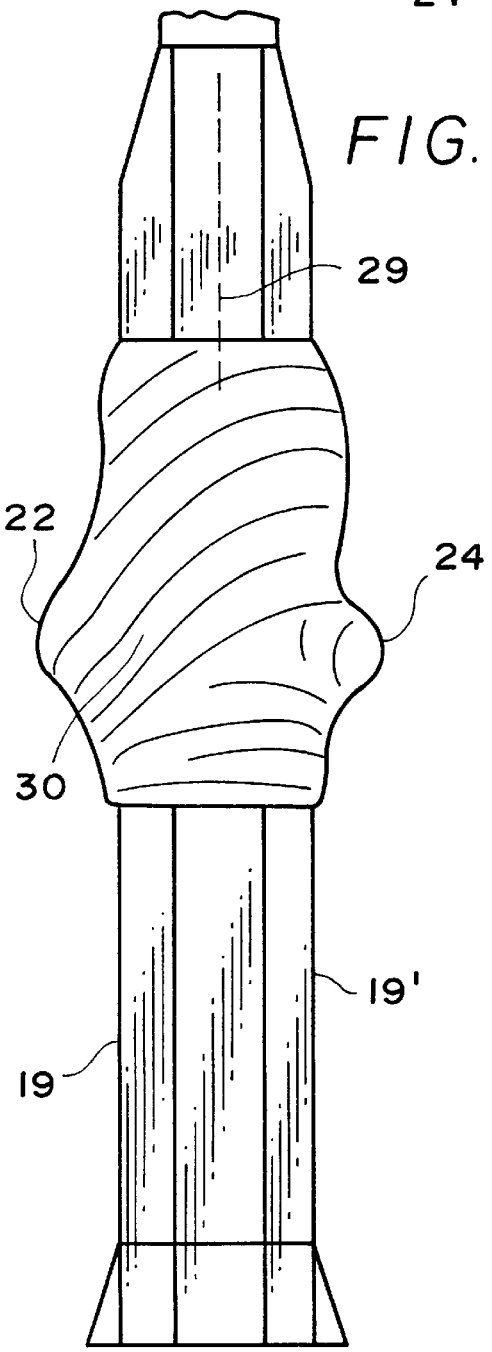
FIG. 8 is a right side view of the embodiment of FIG. 7 disclosing contours that form an offset bulge on the top surface of the handle and a trigger on the lower surface.
Figure 9:
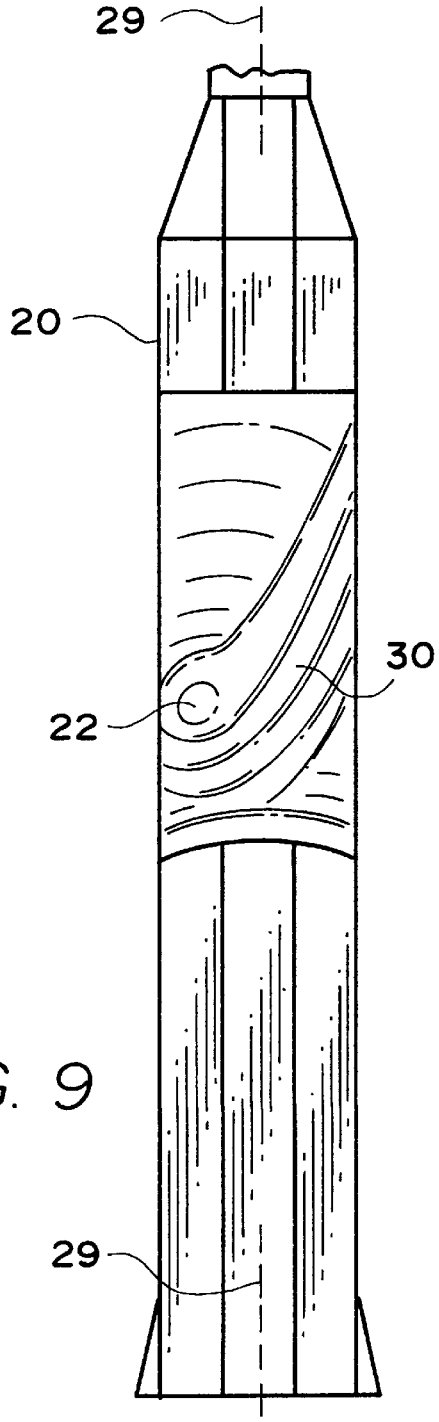
FIG. 9 is a top plan view of FIG. 8 showing the offset bulge with an angled surface to receive the base of the forefinger.

FIGS. 7, 8, and 9 disclose another embodiment wherein the bulge 22 is conveniently located to one side of the handle axis 29 and an angled planar surface 30, extending at a skewed angle to the axis 29, is formed. The surface 30 provides a natural surface for the base of the index finger when a continental grip is assumed and will act as a stop to limit hand rotation and/or correctly position the hand for backhand strokes. As seen in FIG. 7, which shows the side opposite of that shown in FIG. 8, an enlarged area 28 can be formed with a depression 26 in which a player's thumb is received.

Figure 10B:
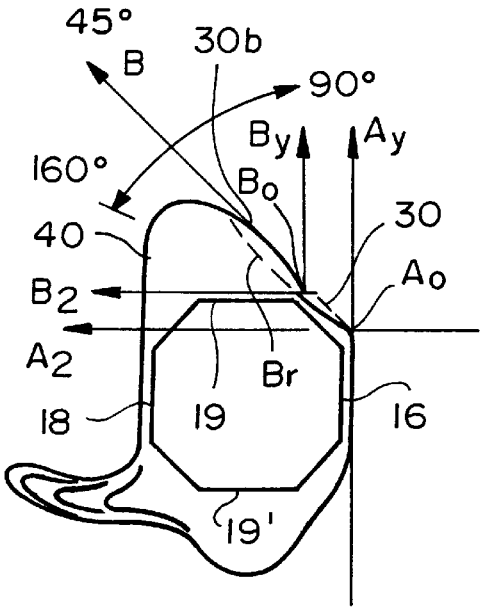
FIG. 10*b* is an end view similar to FIG. 10 showing a coordinate system for illustrating the hand cocking feature of the invention.
Figure 10:
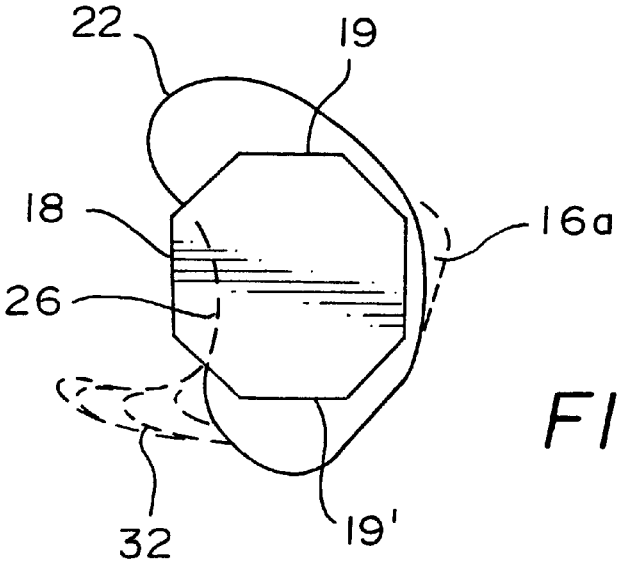
FIG. 10 is a diagrammatic end view of a racquet handle according to another embodiment of the invention showing a bulge extending outside the plane of the octagonal portion of the handle, a pronounced lip to receive the player's thumb, and a planar surface angled outwardly upon which the first knuckle of the index finger may rest.
Figure 10A:
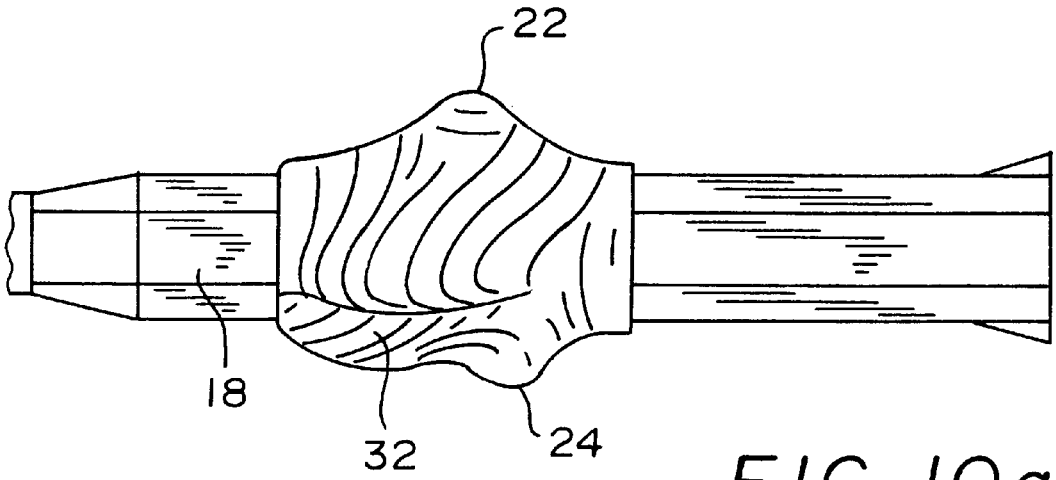
FIG. 10*a* is a left side elevation of the embodiment shown in FIG. 10.
Figure 11:
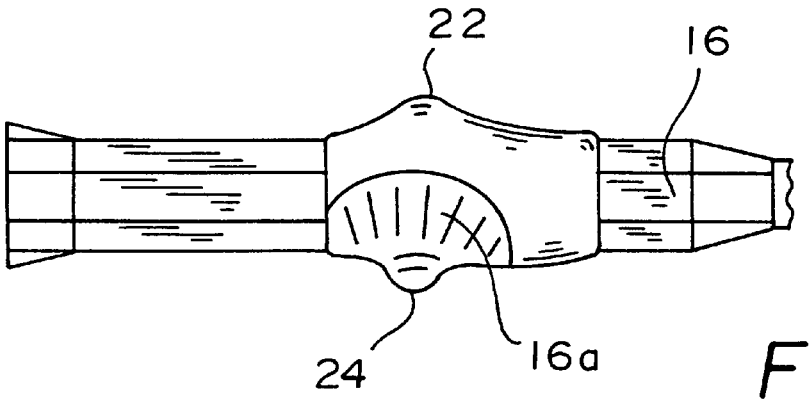
FIG. 11 is a right side view showing the outwardly angled planar surface of FIG. 10.

FIGS. 10 and 10*a* show an assembly configuration wherein the bulge 22 is angled rearwardly ("rearwardly" in the sense that the net or opposing court is located to the right as viewed in FIG. 10) with thumb depression 26 formed with an exaggerated lip 35. The multiple dotted lines show how this lip can be varied in size. Note that the depth of the depression 26 can vary widely depending on player preference. It may be very slight or so deep that its base extends below the side surface 18 of the octagonal handle. When such a configuration is used, the width of handle 20 is reduced in the area of the depression 26. Also, note in FIGS. 10 and 11 that an angled surface 16*a* is provided that angles outwardly. This surface will tilt the first knuckle of the index finger of a player toward a Western forehand position.

Figure 8A:
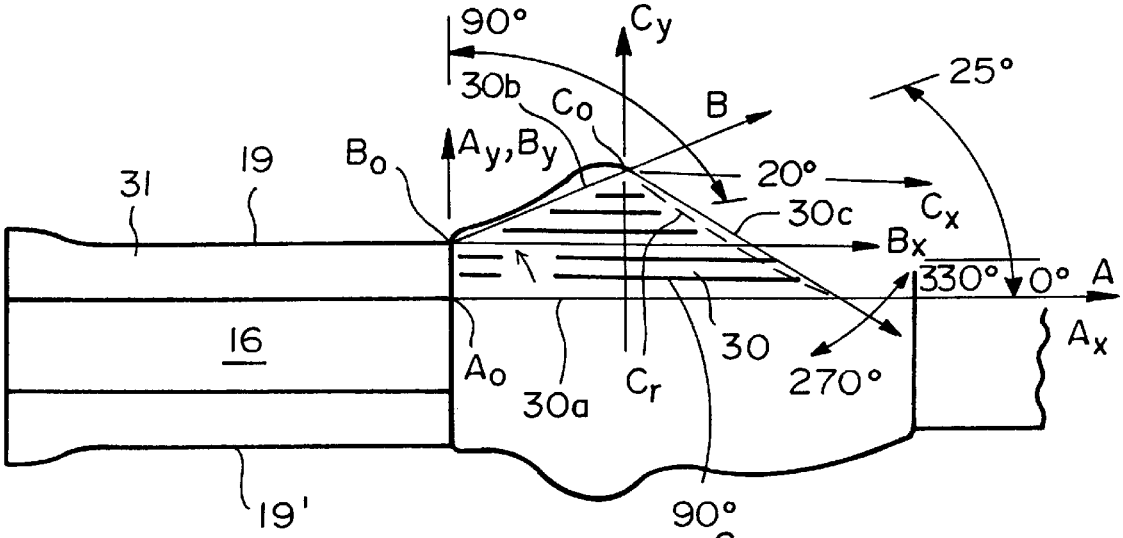
FIG. 8*a* is a right side view similar to FIG. 8 showing a coordinate system for illustrating a feature of the invention for cocking a player's hand.
Figure 9A:
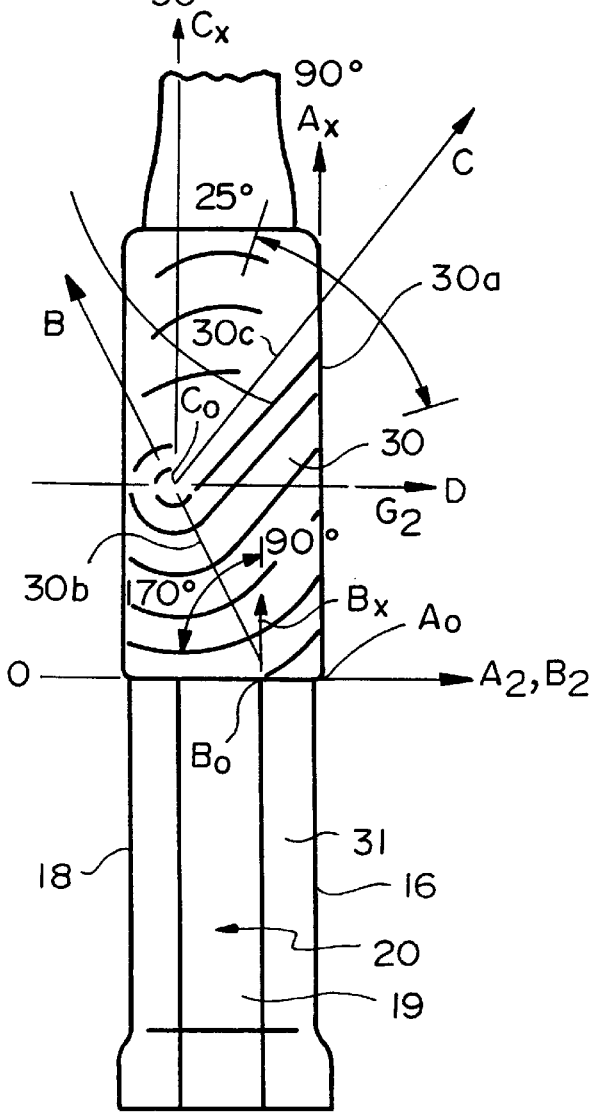
FIG. 9*a* is a top plan view similar to FIG. 9 showing a coordinate system for illustrating the hand cocking feature of the invention.

The orientation angle of surface 30 can be varied from the orientation shown in FIGS. 8, 9, and 10 to achieve a cocked hand position that some players prefer. FIGS. 8*a,* 9*a,* and 10*b* illustrate three orthogonal views of the surface 30 with coordinate systems superimposed thereon to show the geometry. FIG. 8*a* illustrates an X-Y plane view, FIG. 9*a* illustrates an Z-X plane view, and FIG. 10*b* illustrates a Z-Y plane view. There are three vectors of interest in defining the angle of surface 30 and its effect on hand position. A first vector A extends from an origin A. located at the uppermost end of the handle base portion 20*a* and at the intersection between the handle side surface 16 and a diagonal surface 31 extending between the side surface 16 and the top surface 19. Vector A extends from its origin A. along the top of the side surface 16 to define a first side 30*a* of the angled surface 30. A second vector B extends from an origin B. located at the uppermost end of the handle base portion 20*a* and at the intersection between the top surface 19 and the diagonal surface 31. Vector B extends from its origin B. and intersects the highest point of the protrusion 22 to define a second side 30*b* of the surface 30. A third vector C extends from an origin C. located at the intersection of vector B and the highest point of the protrusion 22. Vector C then extends downwardly from its origin C. to intersect vector A, and defines a third side 30*c* of the surface 30.

The angle formed by the face of surface 30 can be changed by adjusting the direction of the vectors A, B, and C. As shown in FIG. 8*a,* vector A can be adjusted in the X-Y plane defined by axes $A_x$ and $A_y$ between a nominal angle of about 0° to an angle of about 25°. Upward adjustment of vector A in the X-Y plane tends to flatten the angled surface 30 so as to raise the player's forefinger and cock the hand back. This increases the player's wrist action and is useful for increasing service power.

As shown in FIGS. 8*a,* 9*a,* and 10*b,* the vector B can be adjusted in all three planes. As shown in FIG. 8*a,* vector B can be adjusted in the plane defined by axes $B_x$ and $B_y$ between about 20° and 90°. Upward adjustment of the angle of vector B in the X-Y plane tends to steepen the slope of the protuberance 22, which helps cock the hand back for power service. As shown in FIG. 9*a,* vector B can be adjusted in the plane defined by axes $B_x$ and $B_y$ between about 90° and 170°. Upward adjustment of the angle of vector B in the Z-X plane moves the protuberance 22 toward the rearward side 18 and the base end 25 of the handle, which again helps cock the player's hand back. As shown in FIG. 10*b,* vector B can be adjusted in the plane defined by axes $B_z$ and $B_y$ between about 90° and 160°. Upward adjustment of the angle of vector B in the Z-Y plane moves the protuberance 22 toward the rearward side 18 of the handle 20.

As shown in FIGS. 8*a* and 9*a,* vector C can be varied in the X-Y plane and the Z-X plane. As shown in FIG. 8*a,* vector C can be varied in the plane defines by axes $C_x$ and $C_y$ between about 270° and 330°. Upward adjustment of vector C in the X-Y plane flattens the surface 30 and increases cocking of the player's hand. As shown in FIG. 9*a,* vector C can be varied in the plane defined by axes $C_z$ and $C_x$ between about 20° and 70°. Upward adjustment of vector C in the Z-X plane tends to cock the player's wrist to the left (for right-handed players) by leftward rotation of the player's forefinger.

It will also be observed, in FIG. 10*b* in particular, that the angled surface 30 need not be planar. It may have a concave curvature with a positive radius of curvature or a convex curvature with a negative radius of curvature. FIG. 10*b* illustrates a radius of curvature Br taken along vector B. As shown in FIG. 8*a,* another radius of curvature Cr can be taken along vector C. As shown in FIG. 9*a,* different radii of curvature could be measured on angled surface 30 in any direction between vectors B and C, it being understood that surface 30 could have a complex compound curvature. Along any given vector extending from origin $C_o$, the curvature of surface 30 could range anywhere from infinity, for a planar surface, to as little as one inch or less, for a highly curved concave surface, to negative values for a concave surface.

Figure 12:
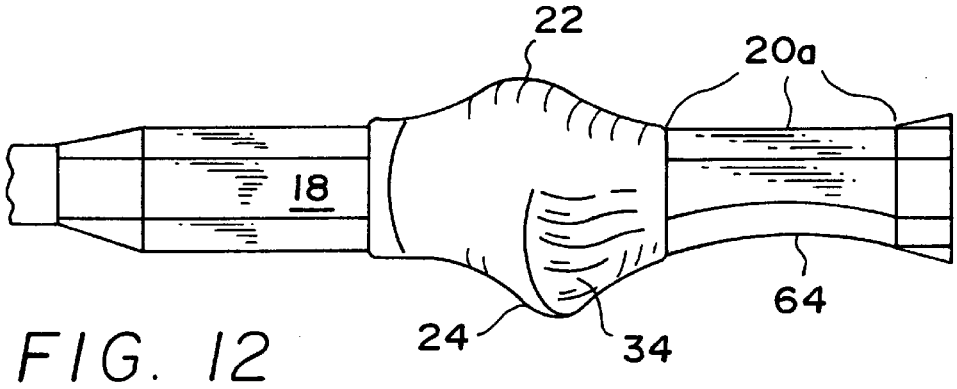
FIG. 12 is a side elevational view disclosing another embodiment of the invention in which there is a transverse thumb groove and also showing a reduced (concaved) periphery of the handle in the area of the grasping fingers.

Turning now to FIG. 12, the lower handle portion 20*a* of the racquet R next to the base 25 can be formed with a gentle arc 64 on the surface below the trigger 24. This provides a comfortable position (reduced periphery) for the three fingers which grasp that portion of the racquet, especially when a backhand grip is used. The concave surface formed by arc 64 can be used on all the embodiments described. This reduction in handle diameter can also be formed by shaving or otherwise reducing the ridged portions of the lower handle portion 20*a,* as shown by numerals 70 and 72 in FIGS. 12*a* and 13. As seen in those figures, tapering depressions 70 and 72 will provide a better grasp for some players by reducing the periphery of the handle in the area of the grasping fingers.

Figure 12A:
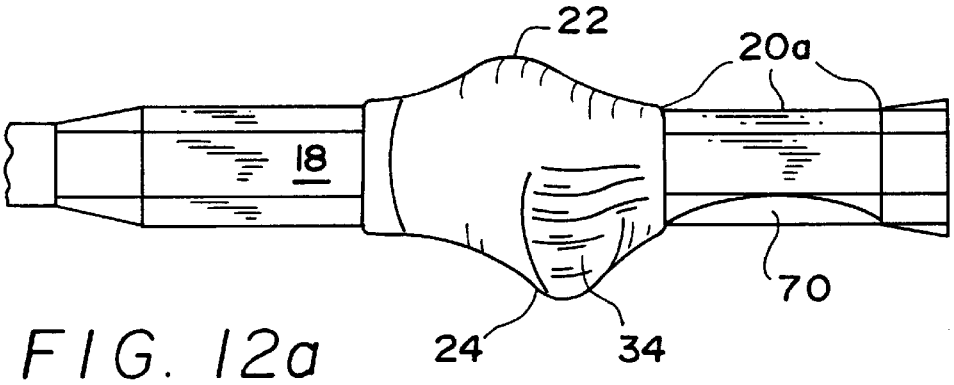
FIG. 12*a* is a view similar to FIG. 12 showing a transverse thumb groove and also showing a reduced (tapered) periphery of the handle in the area of the grasping fingers.
Figure 13:
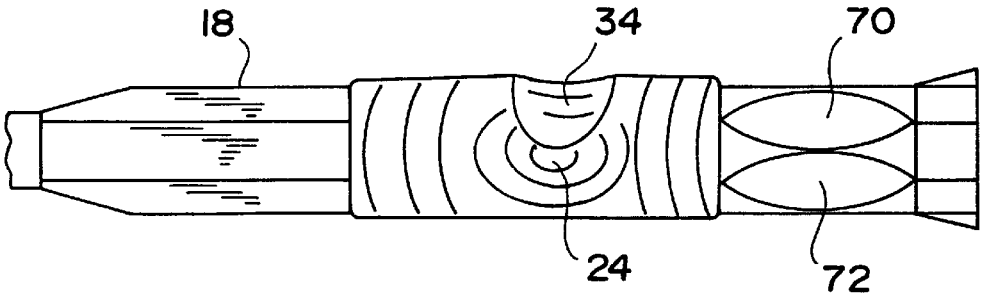
FIG. 13 is a bottom plan view of FIG. 12*a* showing how the transverse groove is partially formed in the trigger and disclosing structure for reducing the periphery of the handle base as disclosed in FIG. 12*a;*

In the parent applications, the thumb-receiving surfaces or bowls are formed so that the thumb is fully supported while angularly disposed with respect to the axis of the handle. Some players prefer to have the thumb in a plane perpendicular or almost perpendicular to the axis of the handle to effect a Western backhand grip. An embodiment with this improvement is seen in FIGS. 12, 12*a,* 13, and 14. A groove 34 is formed transverse to the axis of the handle. Note in FIG. 13, in particular, this groove is partially formed in trigger 24. The thumb depression groove 34 does not interfere with the main functions of the trigger element.

Figure 14:
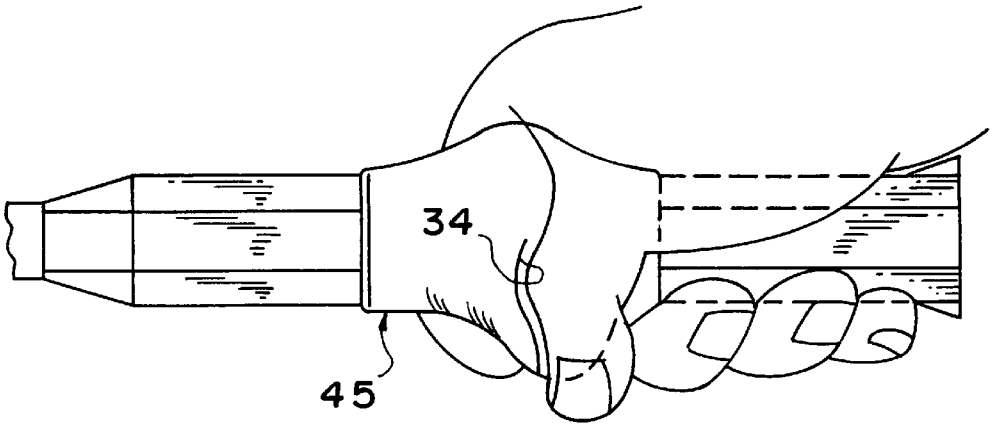
FIG. 14 is a side elevational view disclosing the embodiment of the invention in which there is a thumb groove transverse to the axis handle and also showing a player's hand and a handle without a lower handle concavity.

FIG. 14 shows the transverse thumb groove 34 without any concavity in the lower handle position 20*a.*

FIG. 15 is a side elevational view showing the thumb located in a transverse depression 37 depicted by a circle. The same player can use the oval depression 39 if that is more comfortable and advantageous. In all variations of the invention, a player can dispose his hand in certain but different positions. Also, the designs herein shown will strengthen many shots—for instance, the backhand—without interfering with a player's forehand and volley shots.

FIG. 16 is a side elevational view demonstrating two contoured areas on a handle 20. The first area 50, nearest the base 25 of the handle 20, is for the one hand, and a second area 52, placed farther up the handle 20 in the reverse direction, is to accommodate the other hand. This enables a two-handed player to take advantage of the contoured area configurations disclosed herein.

FIG. 17 is a side elevational view showing the angularly disposed planar surface 67. FIG. 18 is a cross-sectional view taken along line 18—18 in FIG. 17. The planar surface 67 is oriented at an angle to the plane of the racquet head. When gripped, this angularly disposed surface 67 will have a tendency to cause the user to tilt the racket head, making it easier to execute top spin backhands.

Although the foregoing configurations are believed to work best for most players, there may be some players who prefer handles with only some of the disclosed configuration elements. It will be understood, therefore, that each of the disclosed configuration elements could be used either alone or in combination with other configuration elements. For example, some players may prefer to use one or more thumb depressions in combination with one or more triggers, but not a bowl or protrusion for engaging the area between the thumb and forefinger. Still other players may find it beneficial to combine one or more thumb depressions with a bowl or protrusion, but not a trigger. As previously stated, the depth of the one or more thumb depressions can vary depending on player preference.

The handle configurations taught herein and in the parent applications can be integrally formed on a racquet by molding or otherwise shaping the racquet material itself. For example, if the racquet has a wood frame, the handle can be formed by shaping the wooden stem portion of the racquet frame into one of the disclosed configurations. Modern day octagonal racquet handles, however, are usually formed as a tubular plastic sleeve mounted over an inner handle shaft of rectangular shape. It is contemplated that the disclosed handle configurations can also be formed as a tubular element slipped over the end of an existing handle structure.

The tubular element could replace the conventional octagonal handle or could be mounted over it. Alternatively, the tubular element could be mounted over other handle structures having other shapes. In each case, when a tubular construction is used, the interior configuration of the tube is preferably shaped to closely match the exterior configuration of the handle structure on which it is mounted. If the handle structure on which the tubular element is mounted is octagonal, which it would be if the tubular element is mounted over an existing octagonal handle, the interior surface is formed octagonally. If the handle structure on which the tubular element is mounted is rectangular, which it would be if the tubular element is added during initial racquet manufacture, or if the tubular element is added to an existing racquet after removing the original octagonal handle, the interior surface is formed rectangularly. If the interior of the tubular element does not conform exactly to the shape of the surface on which the element is mounted, it should at least fit snugly enough to prevent relative movement between the two structures.

It has been found that there are sometimes factors of economy and performance which can be obtained if the tubular element is molded separately of two different contoured pieces 44 and 46. The pieces can then be connected into a contoured assembly 45. This method will preserve the integrity of normal racquet production while permitting a great deal of tailoring for the hand of the particular player involved.

Figure 19A:
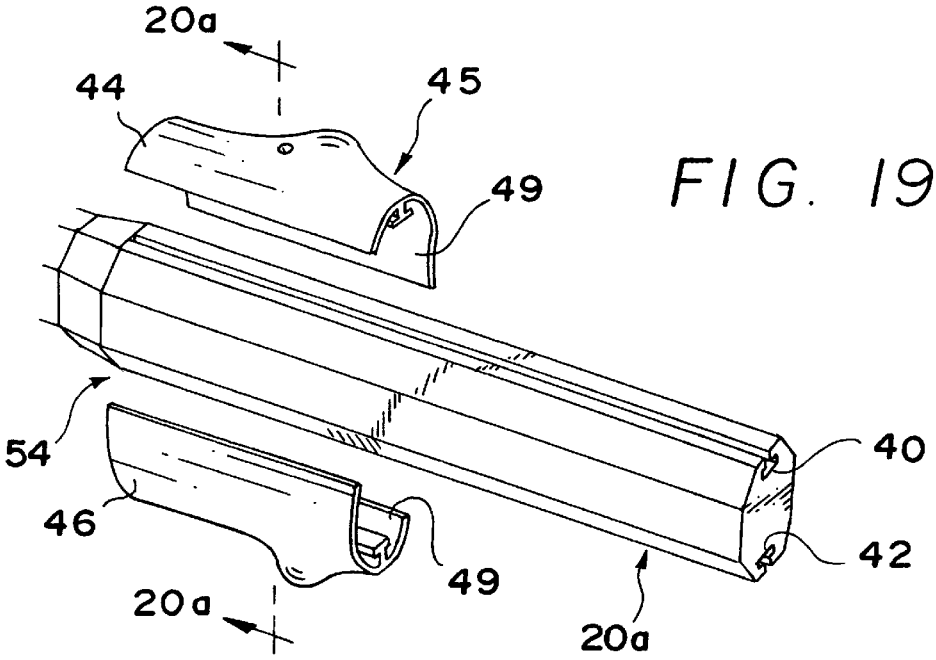
FIG. 19*a* is an exploded perspective showing a two-piece contour assembly in accordance with one method of implementing the invention.

In FIG. 19*a* there are a pair of contoured elements 44 and 46 that, when connected together, form an octagonal inner surface 49 to engage the octagonal periphery 54 of a handle structure in the form of the lower handle portion 20*a.*

Figure 20A:
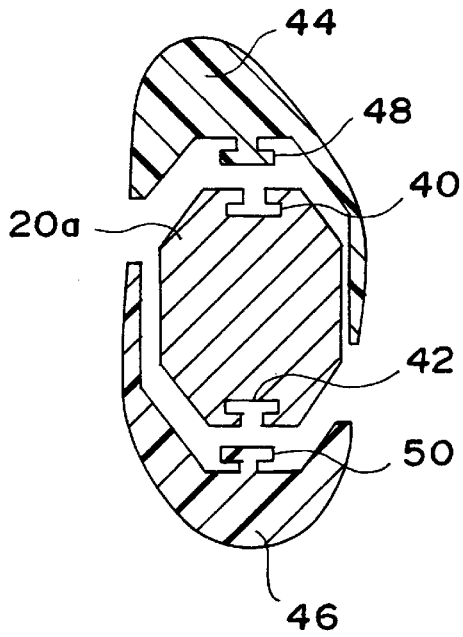
FIG. 20*a* is a cross section taken along line 20*a*—20*a* in FIG. 19*a* showing a pair of contour elements about to be assembled.
Figure 21A:
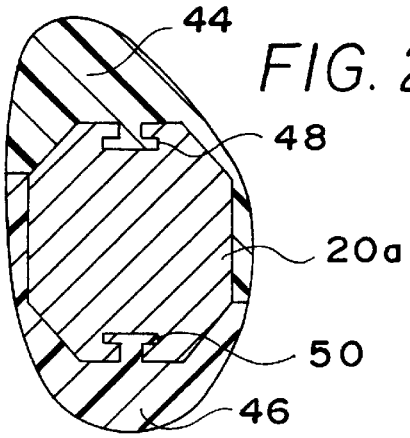
FIG. 21*a* is the cross section of FIG. 20*a* showing the contour elements formed as a contour assembly.

If desired, the elements 44 and 46 can be made to snap together around the handle portion 20*a.* Alternatively, as seen in FIG. 19*a,* the upper and lower surfaces of the handle portion 20*a* can be formed with T-shaped grooves 40 and 42 substantially throughout the length thereof. As shown in FIGS. 20*a* and 21*a,* the interior of elements 44 and 46 are formed with one or more T-shaped members or rails 48 and 50, respectively, for reception by these grooves. Extending downwardly from upper piece 44 is a T-shaped rail 48 adapted to be snugly received in a matching groove 40. Extending upwardly from lower piece 46 is a T-shaped rail 50 adapted to be snugly but slidably received in a groove 42. The assembly 45 can have the configurations molded according to any of the embodiments shown in this or in the parent applications.

Figure 22A:
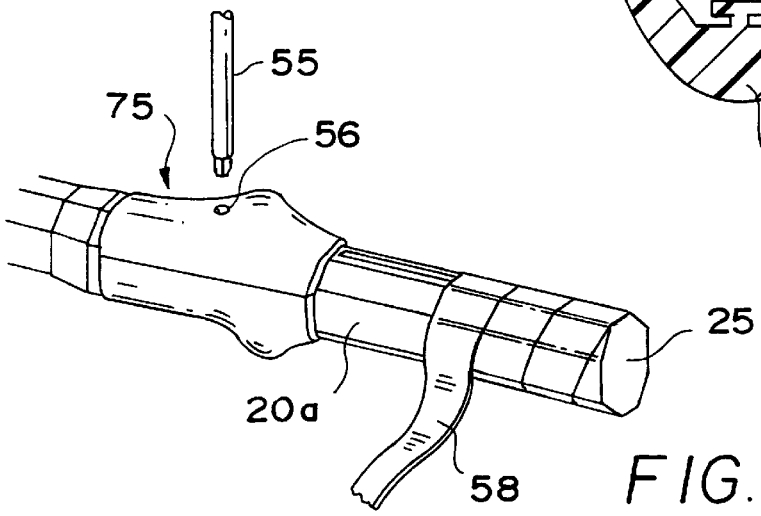
FIG. 22*a* is a perspective of a handle in accordance with FIG. 19*a* during the final stages of assembly.

As seen from FIG. 22*a,* a tubular element 75 is made either as a unitary sleeve or formed from the two contoured elements 44 and 46 connected together as the contour assembly 45. The tubular element 75 can be moved axially along the lower handle portion 20*a* to a selected location where the tubular element can be affixed to the handle by way of a screw 55 or the like. The upper side of the tubular element 75 is formed with an aperture 56 to receive the screw 55.

After securement of the tubular element 75, the remainder of the lower handle portion 20*a* is then wrapped by a conventional strap 58 (usually leather) in known fashion from the base 25 up to the tubular element 75. The strap is secured and bonded to the handle in the normal fashion.

Figure 19B:
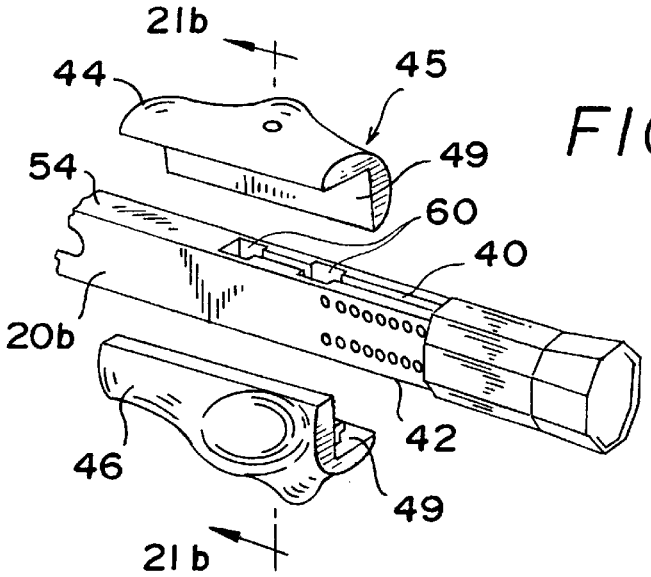
FIG. 19*b* is an exploded perspective showing a two-piece contour assembly in accordance with another method of implementing the invention.

In FIG. 19*b* there are a pair of contoured elements 44 and 46 that, when connected together, form a rectangular inner surface 49 to engage the rectangular periphery 54 of a handle structure in the form of a handle inner shaft 20*b.*

Figure 20B:
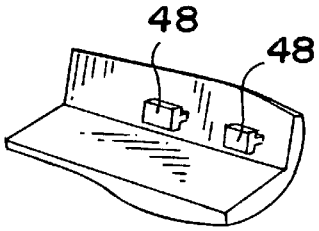
FIG. 20*b* is a partial bottom view of one of the contour elements shown in FIG. 19*b* disclosing inwardly directed rails.
Figure 21B:
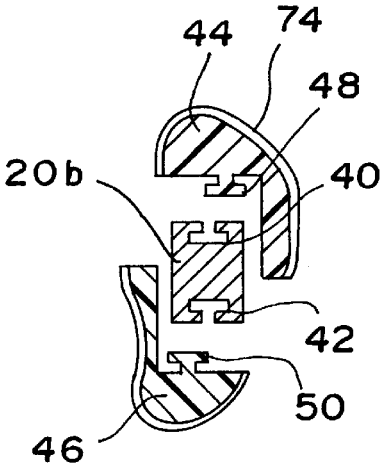
FIG. 21*b* is a cross section taken along line 21*b*—21*b* in FIG. 19*b* showing the contour elements formed as a contour assembly.

If desired, the elements 44 and 46 can be made to snap together around the handle inner shaft 20*b.* Alternatively, as seen in FIG. 19*b,* the upper and lower surfaces of the handle inner shaft 20*b* can be formed with T-shaped grooves 40 and 42 substantially throughout the length of the handle inner shaft. As shown in FIGS. 20*b* and 21*b,* the interior of elements 44 and 46 are formed with two T-shaped members or rails 48 and 50, respectively, for reception by these grooves. Thus, extending downwardly from upper piece 44 are two T-shaped rails 48 adapted to be snugly received in a matching groove 40. Extending inwardly and upwardly from lower piece 46 are two T-shaped rails 50 adapted to be snugly but slidably received in a groove 42. Enlarged openings 60 along the grooves 40 and 42 are sized to receive the flanged portions of the T-shaped rails 48 and 50, and will facilitate mounting the pieces 44 and 46 to the handle inner shaft 20*b*. The assembly 45 can have the configurations molded according to any of the embodiments shown in this or in the parent applications.

FIG. 21*b* shows an exterior covering 74 over contoured elements 44 and 46. The covering 74 is made of a cushioning material which adds to comfort and shock absorption.

Figure 22B:
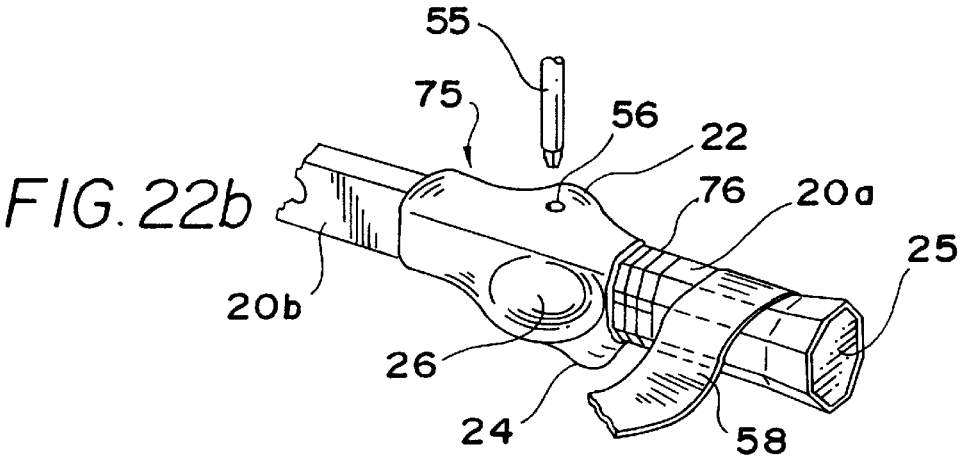
FIG. 22*b* is a perspective of a handle in accordance with FIG. 19*b* during the final stages of assembly.

As seen from FIG. 22*b*, a tubular element 75 is made either as a unitary sleeve or formed from the two contoured elements 44 and 46 connected together as the contour assembly 45. The tubular element 75 which can be moved axially along the handle inner shaft 20*b* to a selected location where the tubular element can be affixed to the handle by way of a screw 55 or the like. The upper side of the tubular element 75 is formed with an aperture 56 to receive the screw 55.

Figure 23:
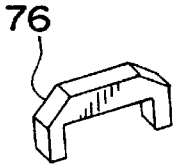
FIG. 23 is a perspective view of a two-piece spacer piece.
Figure 24:
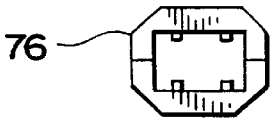
FIG. 24 discloses how the spacer pieces of FIG. 23 engage one another.

After securement of the tubular element 75, the lower handle portion 20*a*, formed by a conventional octagonal sleeve, is mounted on the handle inner shaft 20*b*. The lower handle portion 20*a* is then wrapped by a conventional strap 58 (usually leather) in known fashion from the base 25 up to the tubular element 75. The strap is secured and bonded to the handle in the normal fashion. If a gap remains between the tubular element 75 and the lower handle portion 20*a*, a filler or filler rings 76 can be inserted before wrapping with the strap 58. As shown in FIGS. 23 and 24, the fillers or rings 76 are either friction-fitted or snapped or glued to the handle inner shaft 20*b* prior to wrapping with strap 58. The fillers 76 provide a smooth transition between the tubular element 75 and the lower handle portion 20*a*. They can also be used in the two-handed embodiment of FIG. 16 between the contour areas 50 and 52 to adjust the spacing thereof.

The grooves 40 and 42 need not run the entire length of the handle inner shaft 20*b* if shorter grooves are desired. If shorter grooves are desired, a modification of the T-shaped grooves is made. In the event the tubular element 75 is molded in one piece, the grooves will be formed so as to extend to the lower end of the handle inner shaft 20*b*.

It should be understood that certain commercial adhesives can be used to secure pieces together during assembly. For instance, the engaging of contoured elements 44 and 46 can be secured by an adhesive. The same is true for fillers 76 and 77.

Although the means for securing and locating the tubular element 75 along the length of the handle inner shaft 20*b* is described with respect to a particular contoured assembly, it should be understood that such location means can be used for all embodiments as well as the two-handed embodiment.

Figure 25:
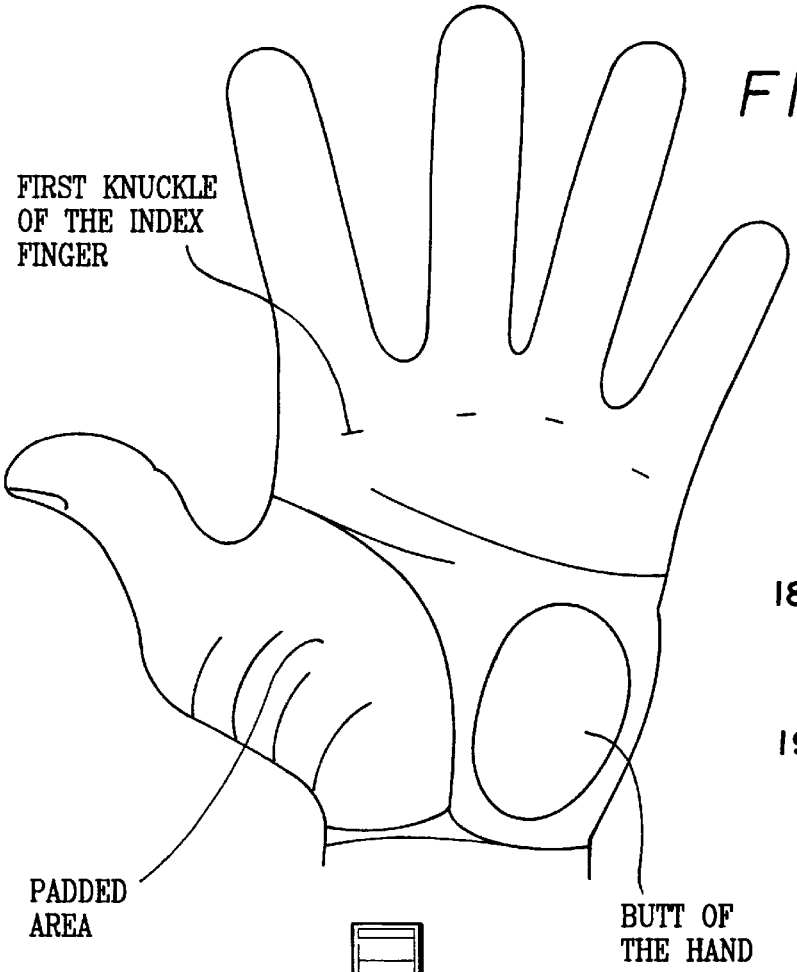
FIG. 25 is a diagrammatic plan view of a player's left hand, which for right handed players would be the secondary playing hand used for two-handed backhand strokes.

Referring now to FIG. 25 for nomenclature purposes, the left hand of a tennis player is shown, which in the case of right handed players, is a secondary hand used for two handed backhand strokes. The index finger, thumb, and the padded saddle area at the base of the thumb contribute guidance, control and power to the player during back hand strokes. The third, fourth, and fifth fingers provide much of the grasping power.

Figure 26:
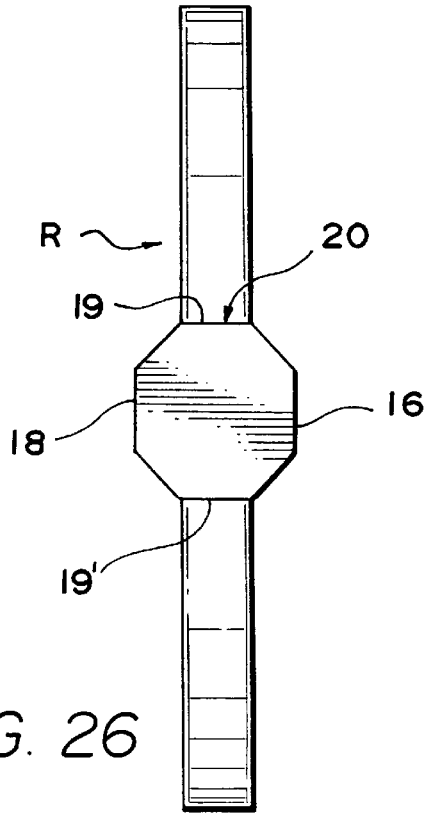
FIG. 26 is an end view of a racket handle showing its orientation relative to a racket head.
Figure 27:
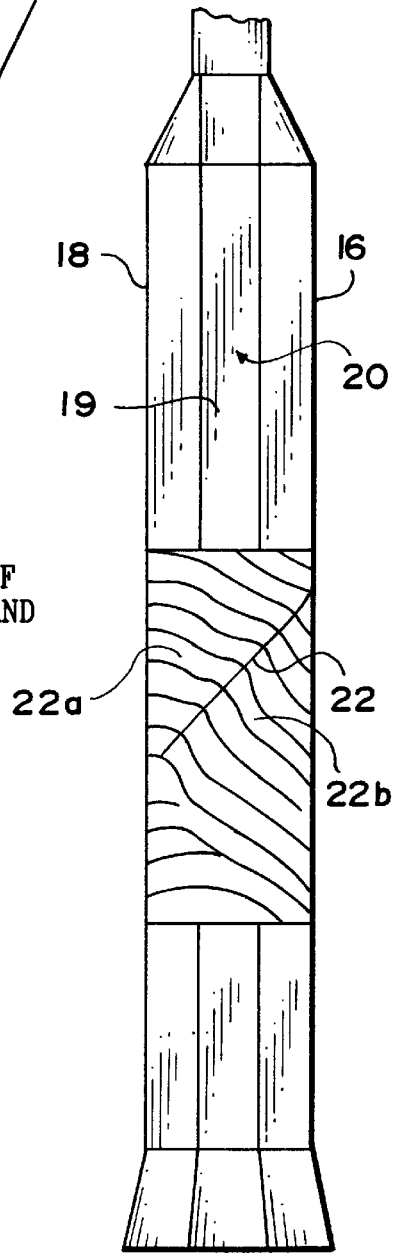
FIG. 27 is a top plan view showing another embodiment of the invention.
Figure 28:
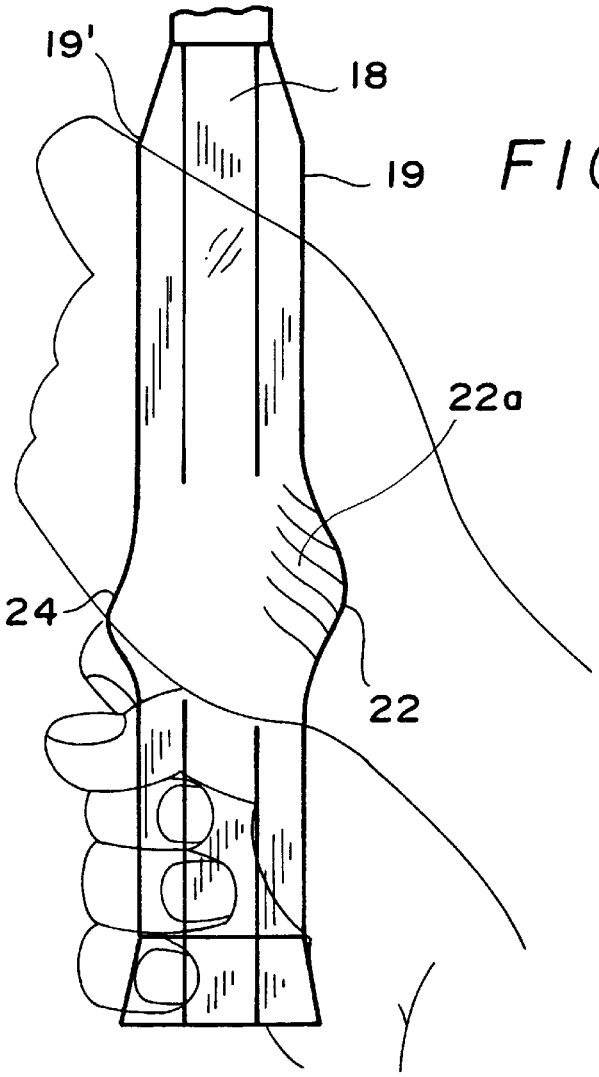
FIG. 28 is a side elevation view showing a two-handed backhand grip using the embodiment of FIG. 27.

Referring now to FIG. 26, wherein like numerals indicate like parts previously shown and described in prior figures, the numeral 20 indicates an octagonal tennis racquet handle of the racquet R. The tennis racquet handle 20 includes side surfaces 16 and 18. The top surface of the octagonal portion of the handle is indicated by the numeral 19 and the bottom surface by the numeral 19'.

In the preceding embodiments, a contour area comprising a protrusion 22 and a trigger 24 have been disclosed. The protrusion 22 provides a surface against which the saddle formed by the index finger and the thumb of the player's principal playing hand can be placed. This engagement locates the prinicipal playing hand and/or acts as a pivotal point when changing from forehand to backhand grips and vice versa. The trigger 24 supports the index finger of the principal playing hand for added control and for increasing the player's awareness of his or her principal playing hand along the length of the handle.

Figure 29:
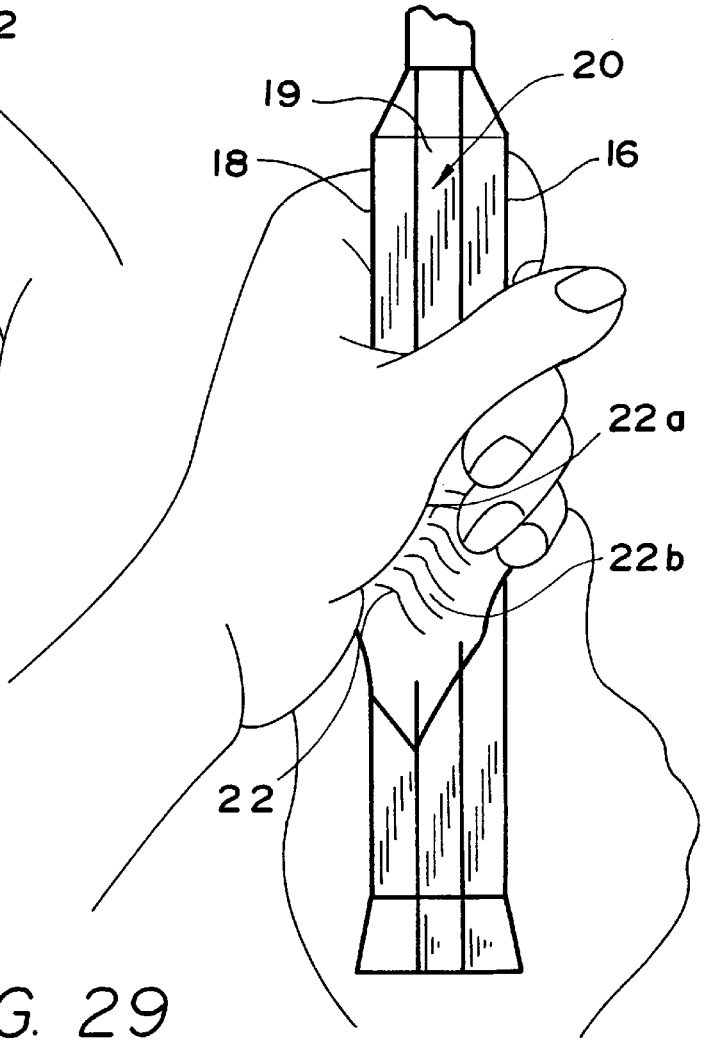
FIG. 29 is a top plan view showing the placement of a secondary playing hand using the embodiment of FIG. 27.
Figure 30:
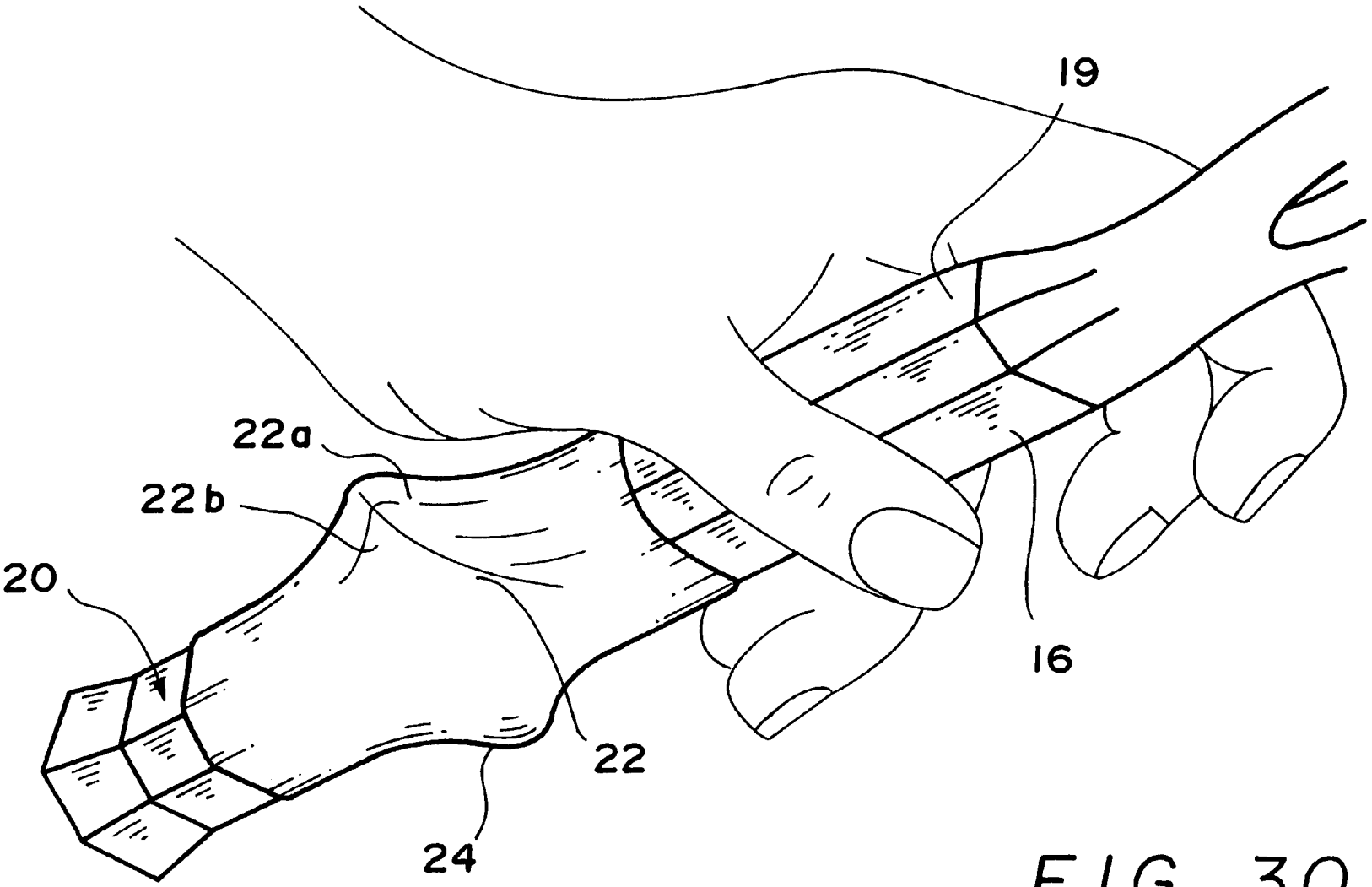
FIG. 30 is perspective view showing the placement of a secondary playing hand using the embodiment of FIG. 27.

As shown in FIGS. 27–30, a single contour area can be constructed for two-handed backhand play by modifying the protrusion 22. In this embodiment the protrusion 22 still receives the area between the thumb and forefinger of the principal playing hand, and the trigger 24 still receives the index finger of the principal playing hand. However, the contour area is adapted to accommodate the secondary playing hand by forming an angled depression 22*a* in the racket head side of the protrusion 22 to receive the padded area at the base of the thumb of the secondary playing hand. The base side 22*b* of the protrusion 22 remains the same as in previous embodiments. The angle of the concavity 22*a* is such that the concavity extends longitudinally from a first end located closest to the base of the handle 20 to a second end located closest to the racket head. Laterally, the concavity 22*a* preferably also extends from the upper edge of the side surface 18 and across the upper surface 19. If desired, the concavity 22*a* can also be extended laterally to the upper edge of the side surface 16. As shown in FIG. 29, the concavity 22*a* is preferably aligned along the line generally formed by the thumb of the secondary playing hand as it wraps around the handle 20. The concavity 22*a* allows the secondary playing hand to be positioned closely adjacent to the principal playing hand for increased power and control during two-handed backhand strokes.

Figure 31:
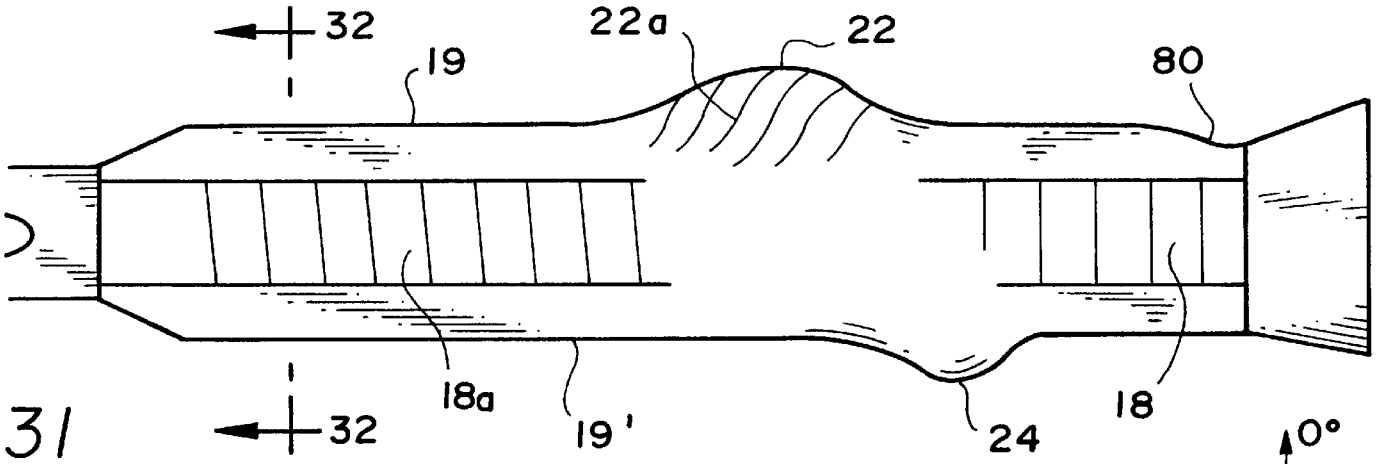
FIG. 31 a side elevation view showing another embodiment of the invention.
Figure 32:
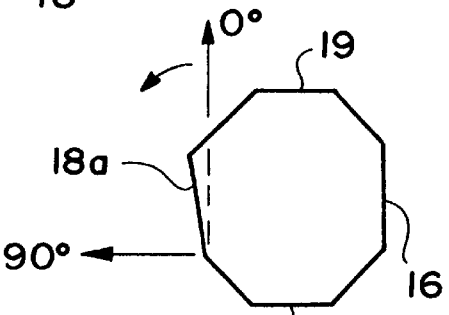
FIG. 32 is a cross-section of FIG. 31 showing an angled side surface to receive the first knuckle of the index finger of a secondary playing hand.

Referring now to FIGS. 31 and 32, it will be seen that the side 18 of the handle 20 can be downwardly angled at the racket head end thereof to form a downwardly angled surface 18*a* that receives the first knuckle of the index finger of the secondary playing hand. This provides a slight Western grip for two-handed backhand strokes. As further shown in FIG. 31, a concavity 80 can be provided in the upper side 19 of the handle 20 to receive the butt of the principal playing hand. The concavity 80 brings the grasping fingers closer together and provides for a better grip on the handle 20. FIG. 31 further shows that the trigger 24 can be positioned toward the base end of the handle 20 relative to the protrusion 22. This configuration can be used so that the thumb of the principal playing hand can engage the trigger 24 during backhand strokes.

Figure 33:
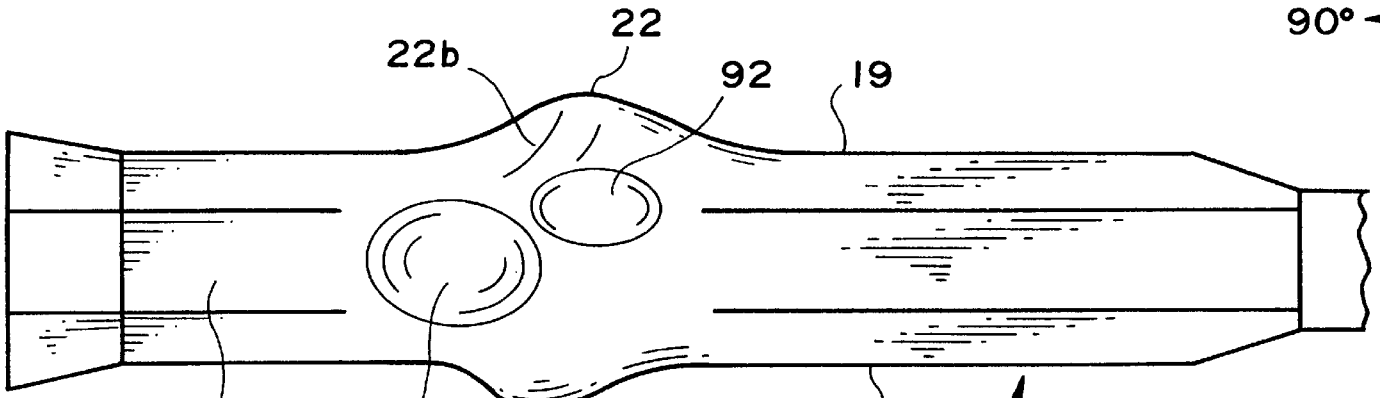
FIG. 33 is a side elevation view showing another embodiment of the invention.

Referring now to FIG. 33, another contour configuration is shown in which one or more indentations 90 and 92 are formed on the net side of the handle 20. The indentations 90 and 92 receive the first knuckle of the index finger of the principal playing hand. The indentation 90 is formed in the side surface 16 of the handle 20 and is useful for forehand strokes. The indentation 92 is formed on or slightly below the surface 22*b* of the protrusion 22 and is useful for serves and volleys.

Figures 34, 35, 36:
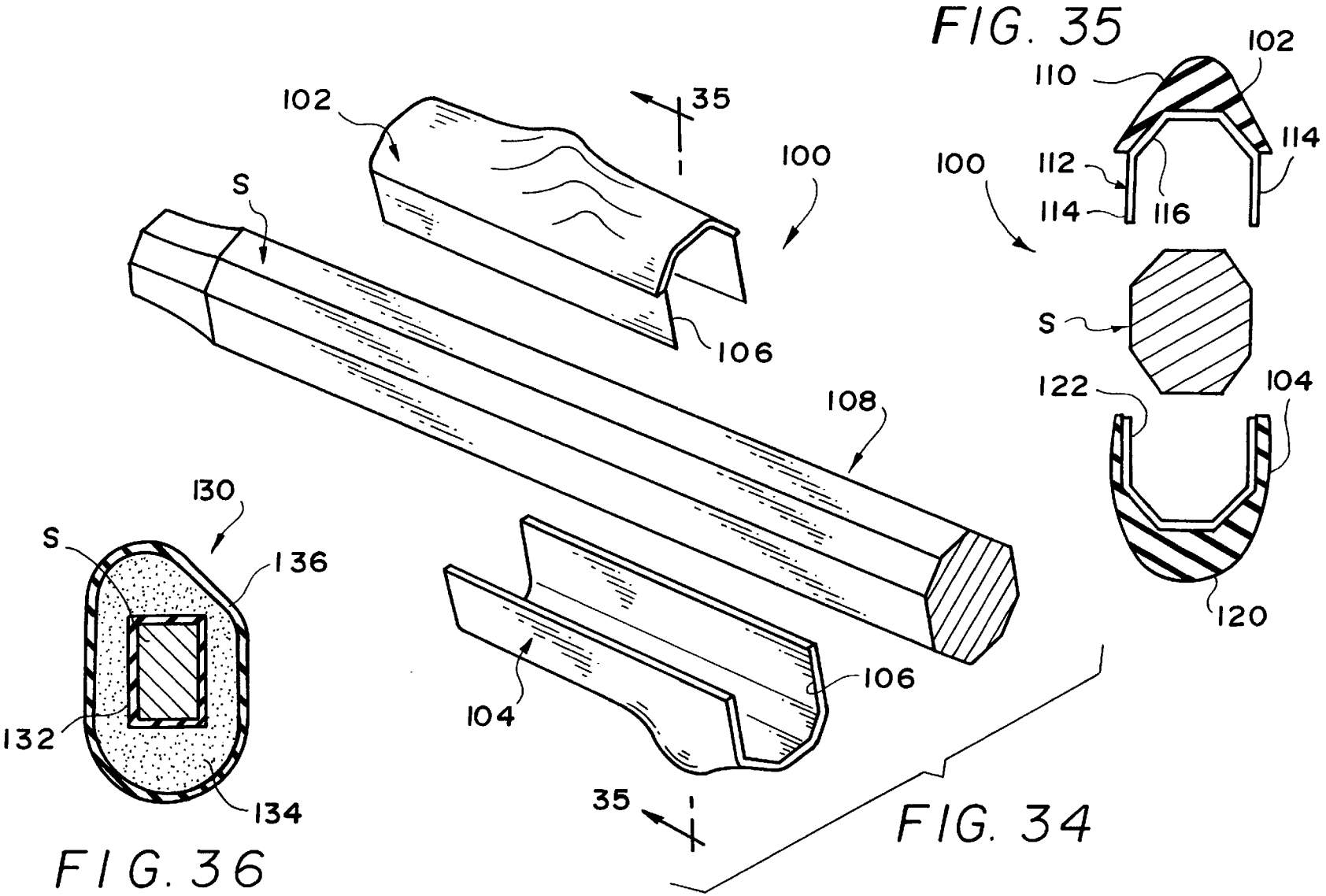
FIG. 34 is an exploded perspective showing a two-piece contour assembly in accordance with another method of implementing the invention.
FIG. 35 is a cross section of FIG. 34.
FIG. 36 is a cross section showing a one piece molded contour assembly in accordance with another method of implementing the invention.

Referring now to FIG. 35, a contour assembly 100 is shown for use in accordance with a useful handle construction method. In FIG. 35 there are a pair of contoured elements 102 and 104 that, when connected together, form an octagonal inner surface 106 to engage the octagonal periphery 108 of a handle shaft S.

The contoured element 102 includes a shaped outer portion 110 made from a suitable semi-soft cushioning material, such as neoprene rubber. The exterior surface of the outer portion 110 is contoured to define an upper portion of one of the contour shapes disclosed above. An inner sheet portion 112 of the contoured element 102 is affixed to, or made integral with, the inner side of the outer portion 110. The inner sheet portion 112 defines a pair of side flaps 114 extending below the outer portion 110. The inner portion 112 can be made from any suitably strong sheet material. An adhesive layer 116 is applied to the inside of the inner portion 112 and the inner portion 112 is made to wrap around and bond to the sides of the handle shaft S. Alternatively, a removable connection could be provided between the contoured element 102 and the handle S.

The contoured element 104 is formed from a shaped outer portion 120 made from a suitable semi-soft cushioning material, such as neoprene rubber. The exterior surface of the outer portion 120 is contoured to define the side and lower portions of one of the contour shapes disclosed above. An adhesive layer 122 is applied to the inner surface of the outer portion 120 and is made to wrap around and bond to the handle shaft S and the side flaps 114 of the inner portion 112 of the contour element 102. Alternatively, a removable connection could be provided between the contoured element 104 and the handle shaft S.

Thus, an integral assembly 100 is formed to define a contour area of a racket. The assembly 100 can have a configuration molded according to any of the embodiments shown in this or in the parent applications.

Referring now to FIG. 36, a unitary molded handle sleeve element 130 is shown. The sleeve 130 is formed over a handle shaft S. It includes a stiff inner frame 132 made from a material such as plastic or aluminum. The inner frame 132 is affixed to the handle shaft S using any suitable means, such as adhesive bonding, or perhaps a removable connection. An intermediate layer 134 is formed, preferably by molding, over the inner frame 132 and is made from a light weight material such as polymeric foam, e.g., expandable polystyrene, expandable polypropylene, or the like. The intermediate layer 134 is configured to define one of the handle contour shapes disclosed above. The intermediate layer 134 is covered, preferably by molding, by an exterior layer 136 made from a semi-soft material such as neoprene rubber. Advantageously, the light weight of the intermediate layer 134 reduces handle weight and thereby increases player comfort and-racket control.

Figure 37:
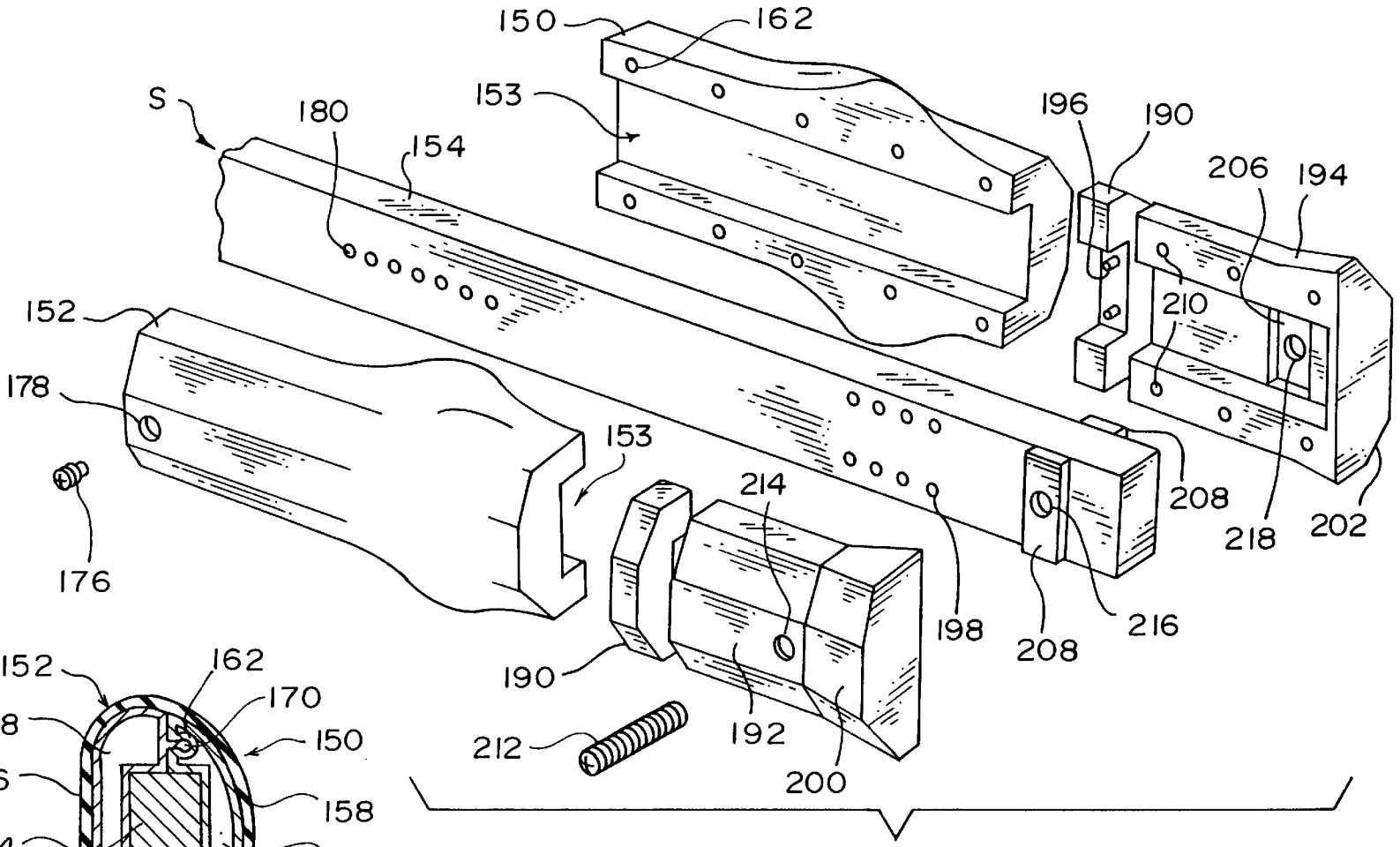
FIG. 37 is an exploded perspective showing a two-piece contour assembly in accordance with another method of implementing the invention.

Referring now to FIG. 37, there are a pair of contoured elements 150 and 152 that, when connected together, form a rectangular inner surface 153 to engage the rectangular periphery 154 of a handle shaft structure S. The handle shaft S is conventional in nature and can be made from wood, metal, composite plastic or any other suitable material.

Figure 38:
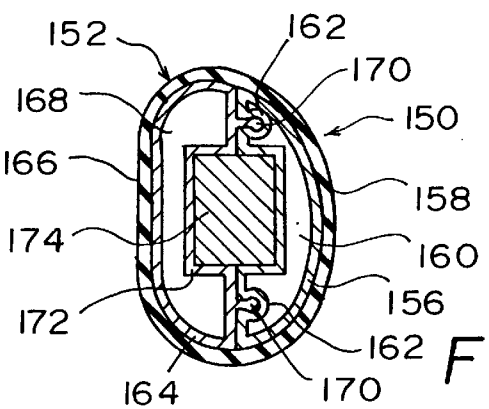
FIG. 38 is a cross section of FIG. 37.

As shown in FIG. 38, each of the contoured elements 150 and 152 have hollow interiors so as to reduce handle weight. The contoured element 150 includes a frame 156 that is preferably made from molded plastic or aluminum, or any other suitable lightweight material. The frame 156 is covered by an exterior layer 158 of a semi-soft material such as neoprene rubber. The frame 156 forms an interior air space 160 that reduces the weight of the element 150. As also shown in FIG. 37, the frame 156 is further formed with upper and lower arrays of snap holes 162 for attaching the element 150 to the element 152.

The contoured element 152 includes a frame 164 that is preferably made from molded plastic or aluminum, or any other suitable lightweight material. The frame 164 is covered by an exterior layer 166 of a semi-soft material such as neoprene rubber. The frame 164 forms an interior air space 168 that reduces the weight of the element 152. The frame 164 is further formed with upper and lower arrays of snaps 170 for attaching the element 152 to the element 150.

The contour elements 150 and 152 are thus preferably made to snap together around the handle shaft S. To achieve further weight savings, the handle shaft itself can be made from a frame 172 made from any suitably strong lightweight material that defines an interior air space 174.

The assembly formed in the manner described above can have a configuration molded according to any of the embodiments shown in this or in the parent applications. The ends of the assembly, however, are preferably octagonally shaped in conventional fashion.

As further shown in FIG. 37, the assembly formed by the contour elements 150 and 152 can be selectively positioned on the handle shaft S using a set screw 176 that extends through a hole 178 in the contour element 152 and threads into one of a plurality of holes 180 formed in the handle shaft S. Alternatively, the set screw 176 could extend through the holes 180 in the handle shaft and thread into one of a plurality of holes (not shown) in the contour element 150. The contour elements 150 and 152 can be mounted on the shaft S at selected locations depending on which of the holes 180 is used to receive the set screw 176.

After securement of the contour elements 150 and 152 using the screw 176, the remainder of the handle can be formed using one or more pairs of gap filler pieces 190 and a pair of handle base elements 192 and 194.

The gap filler pieces 190, which are made from plastic, metal or any other suitable material, are configured to mount to the handle shaft S immediately adjacent the base end of the contour elements 150 and 152. Like the contour elements 150 and 152, the gap filler pieces 190 may have hollow interiors and exteriors coated with a semi-soft material such as neoprene rubber. The gap filler pieces 190 preferably have a conventional octagonal exterior shape. The interiors of the gap filler pieces are U-shaped in order to receive the rectangular shaft S. Each gap filler piece has a pair of snaps 196 formed on an inner side surface thereof. The snaps 196 releasably engage snap holes 198 formed in the sides of the handle shaft S at locations where the gap filler pieces are to be mounted.

The handle base elements 192 and 194, which are made of plastic, metal or any other suitable material, have an octagonal exterior surface and a U-shaped interior surface, much like the gap filler pieces 190. The exterior surface may be coated with a semi-soft material such as neoprene rubber. The handle base elements 192 and 194 are substantially longer than the gap filler pieces 190 and have flared base portions 200 and 202, respectively. In addition, an interior surface of each of the handle base elements 192 and 194 has a recess 206 that engages a bar stop member 208 formed on each side of the shaft S. The bar stop members 208 help maintain the handle base elements in position on the shaft S and prevent them from moving toward the base end thereof. The handle base elements 192 and 194 attach to the shaft S in similar fashion to the contour elements 159 and 152. The handle base element 194 has two rows of snap holes 210 formed on two interior surfaces thereof that mate with corresponding interior surfaces on the handle base element 192. Corresponding snaps (not shown) are formed on the two opposing interior surfaces of the handle base element 192. When the handle base elements 192 and 194 are snapped together, they form a single assembly having a conventional octagonal handle shape. To help secure the handle base elements 192 and 194 to the shaft S, a set screw 212 is mounted so as to extend through a hole 214 formed in the handle base element 192, a hole 216 formed in the shaft S. and into a threaded hole 218 formed in the handle base element 194.

After assembly on the shaft S, the contour elements 150 and 152, the gap fillers pieces 190, and the handle base elements 192 and 194, can be wrapped by a conventional strap (usually leather) in known fashion. The strap is secured and bonded to the handle in the normal fashion.

Alternatively, if a neoprene rubber or the like is coated on the outside of the aforementioned elements, it may be desireable to forego the strap.

There have been described several new racquet handle configurations with means for adjustment. The embodiments described herein are illustrative of the invention but should not be construed as limitations upon the rights of the invention, which are defined by the scope of the hereinafter appended claims.

I claim:

1. A handle configuration for the handle of a racquet that supports a stringed racquet head at its outer end and is terminated at a base comprising a first protrusion located to engage the connecting saddle between the thumb and forefinger of a user's primary playing hand;

a first trigger located to engage the forefinger of a user's primary playing hand when said first protrusion is engaged by said saddle; and an angled concavity disposed on a side of said protrusion face said racquet head to receive the padded area of the thumb of a user's secondary playing hand.

2. The handle configuration of claim 1 further including a downwardly angled surface below said protrusion to receive the first knuckle of the index finger of a user's secondary playing hand.

3. The handle configuration of claim 1 wherein said trigger is spaced from said protrusion in a direction toward a base end of said handle.

4. The handle configuration of claim 1 further including a concavity formed in an upper side of said handle to receive the butt of a user's principal playing hand.

5. The handle configuration of claim 1 further including one or more indentations formed on a side of said handle to receive the first knuckle of the index finger of a user's principal playing hand.

6. A handle configuration in accordance with claim 1 further including a handle shaft having an exterior surface of generally uniform shape;

an assembly having an exterior surface defining said first protrusion, said first trigger and said angled concavity and an interior closely patterned and sized to receive said exterior surface of said handle shaft;

said assembly including first and second contoured elements;

said first contoured element having an outer portion defining an upper portion of said assembly exterior surface and an inner portion made of sheet material and being secured to said handle shaft; and said second contoured element having an outer portion defining lower and side portions of said assembly exterior surface and being secured to said handle shaft and said inner portion of said first contoured element.

7. A handle configuration in accordance with claim 1 further including a handle shaft having an exterior surface of generally uniform shape;

an assembly having an exterior surface defining said first protrusion, said first trigger and said angled concavity and an interior closely patterned and sized to receive said exterior surface of said handle shaft;

said assembly being formed as a sleeve;

said sleeve including a relatively stiff inner frame affixed to said handle shaft;

said sleeve further including an intermediate layer made from a relatively lightweight material; and said sleeve further including an outer layer made from a semi-soft material.

8. The handle configuration of claim 7 wherein said inner frame is made from plastic or aluminum.

9. The handle configuration of claim 7 wherein said intermediate layer is made from an expandable polymeric foam material.

10. The handle configuration of claim 7 wherein said outer layer is made from neoprene rubber.

11. A handle configuration in accordance with claim 1 further including a handle shaft having an exterior surface of generally uniform shape;

an assembly having an exterior surface defining said first protrusion, said first trigger and said angled concavity and an interior closely patterned and sized to receive said exterior surface of said handle shaft; and said assembly including a pair of contoured elements having an outer portion defining said assembly exterior surface and an inner portion having a shape that conforms to said handle shaft exterior surface, said contoured elements being releasably attached to each other and at least one of said contoured elements being releasably attached to said handle shaft.

12. The handle configuration of claim 11 wherein said contoured elements include frame elements covered with a semi-soft cushioning material.

13. The handle configuration of claim 11 wherein said contoured elements have hollow interiors.

14. The handle configuration of claim 11 further including a pair of handle base elements having an outer portion defining a desired shape and an inner portion having a shape that conforms to said handle shaft exterior surface, said handle base elements being releasably attached to each other and at least one of said handle base elements being releasably attached to said handle shaft.

15. The handle configuration of claim 14 further including a pair of gap filler pieces releasably mounted to said handle shaft between said contoured elements and said handle base elements.

* * * * *